US008806682B2

(12) United States Patent
Hornbach et al.

(10) Patent No.: US 8,806,682 B2
(45) **Date of Patent: *Aug. 19, 2014**

(54) ADVANCED ARTICULATION SYSTEM AND MATTRESS SUPPORT FOR A BED

(75) Inventors: David W. Hornbach, Brookville, IN (US); Gregory W. Branson, Batesville, IN (US); Virgil J. Niese, Batesville, IN (US); Rachel H. King, Lawrenceburge, IN (US); Francis C. Ganance, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 445 days.

This patent is subject to a terminal disclaimer.

(21) Appl. No.: 11/962,682

(22) Filed: Dec. 21, 2007

(65) Prior Publication Data

US 2008/0127421 A1 Jun. 5, 2008

Related U.S. Application Data

(63) Continuation of application No. 11/192,698, filed on Jul. 29, 2005, now Pat. No. 7,325,265.

(60) Provisional application No. 60/592,613, filed on Jul. 30, 2004.

(51) Int. Cl.
*A47B 7/02* (2006.01)

(52) U.S. Cl.
USPC ..... 5/618; 5/611; 5/619; 5/614; 5/616; 5/613; 5/617

(58) Field of Classification Search
USPC ..... 5/611, 619, 614, 616, 613, 617, 618; 297/301.2, 301.5, 325
See application file for complete search history.

(56) References Cited

U.S. PATENT DOCUMENTS

| | | | |
|---|---|---|---|
| 137,596 | A | 4/1873 | Clinton et al. |
| 139,493 | A | 6/1873 | Bray |
| 154,060 | A | 8/1874 | Mahler |
| 359,879 | A | 9/1887 | Miller |
| 428,938 | A | 5/1890 | Oxley |
| 501,006 | A | 7/1893 | Goodwin |
| 544,117 | A | 8/1895 | Pitkin |
| 673,366 | A | 4/1901 | Luria |
| 838,697 | A | 12/1906 | Donaldson et al. |
| 866,309 | A | 9/1907 | Scanlan |
| 912,214 | A | 2/1909 | Ward |

(Continued)

OTHER PUBLICATIONS

Track Rollers, McMaster-Carr, Date unknown, www.mcmaster.com/asp/DisplCtlgPage.asp?ReqTyp=CATALOG&CtlgPgNbr=990 &CtlgEdition=. . .(3pages).

(Continued)

*Primary Examiner* — Robert G Santos
*Assistant Examiner* — David E Sosnowski
(74) *Attorney, Agent, or Firm* — Barnes & Thornburg LLP

(57) ABSTRACT

A bed including an articulation system is provided. The bed includes a frame and an actuator coupled to the frame. The bed further includes an arcuate member and a plurality of deck sections. The arcuate member is coupled to the actuator and one of the plurality of deck sections. The actuator operates to move the arcuate member to rotate the thigh section around a natural hip pivot point of a person positioned on the bed.

19 Claims, 14 Drawing Sheets

(56) References Cited

U.S. PATENT DOCUMENTS

| | | | |
|---|---|---|---|
| 942,354 | A | 12/1909 | Ryan |
| 1,005,916 | A | 10/1911 | Wunning |
| 1,296,451 | A | 3/1919 | Arrigoni |
| 1,332,546 | A | 3/1920 | Dodds |
| 1,356,467 | A | 10/1920 | Payne |
| 1,363,295 | A | 12/1920 | Wallace |
| 1,394,985 | A | 10/1921 | Fischer |
| 1,579,604 | A | 4/1926 | Fedosenko |
| 1,709,137 | A | 4/1929 | Loxley |
| 1,713,164 | A | 5/1929 | Berry |
| 1,818,598 | A | 8/1931 | Berry |
| 1,973,699 | A | 9/1934 | Bradley |
| 2,101,290 | A | 12/1937 | Pierson |
| 2,159,883 | A | 5/1939 | Caldwell |
| 2,271,201 | A | 1/1942 | Mehr |
| 2,416,410 | A | 2/1947 | Hyman |
| 2,538,993 | A | 1/1951 | Travis |
| 2,560,465 | A | 7/1951 | McVicker |
| 2,670,476 | A | 3/1954 | Travis |
| 2,682,913 | A | 7/1954 | Manternach |
| 3,338,632 | A | 8/1967 | Kleinsorge |
| 3,353,193 | A | 11/1967 | Greiner |
| 3,406,772 | A | 10/1968 | Gustav et al. |
| 3,839,753 | A | 10/1974 | Benoit et al. |
| 4,097,940 | A | 7/1978 | Tekulve et al. |
| 4,371,996 | A | 2/1983 | Nahum |
| 4,406,027 | A | 9/1983 | Bourda |
| 4,541,622 | A | 9/1985 | Tabuchi |
| 4,787,104 | A | 11/1988 | Grantham |
| 4,974,905 | A | 12/1990 | Davis |
| 5,040,253 | A | 8/1991 | Cheng |
| 5,640,730 | A | 6/1997 | Godette |
| 5,782,869 | A | 7/1998 | Berdut |
| 5,926,878 | A | 7/1999 | Morton et al. |
| 6,056,363 | A * | 5/2000 | Maddox ..... 297/325 |
| 6,347,420 | B2 | 2/2002 | Elliott |
| 6,393,641 | B1 | 5/2002 | Hensley |
| 6,516,480 | B2 | 2/2003 | Elliott |
| 6,691,346 | B2 * | 2/2004 | Osborne et al. ..... 5/600 |
| 6,974,186 | B1 | 12/2005 | Chang |
| 6,978,500 | B2 | 12/2005 | Osborne et al. |
| 2002/0174487 | A1 | 11/2002 | Kramer et al. |
| 2002/0178502 | A1 | 12/2002 | Beasley et al. |
| 2003/0213065 | A1 | 11/2003 | Bristotti |
| 2004/0103476 | A1 | 6/2004 | Barcesat |
| 2005/0172405 | A1 | 8/2005 | Menkedick et al. |

OTHER PUBLICATIONS

Cam Followers, McGill, www.emerson-ept.com/eptroot/public/prod/McGCamFI/McCamF.htm, date unknown, (5 pages).

Shoulder Bolt, Viking Engineering & Development, www.vikingeng.com/detail.asp?PRODUCT_ID=950-70-598, date unknown (1 page).

Designing and Selecting Long-Duration Seating for the Aging, Joseph A. Koncelik, Nursing Homes, pp. 27-28, Oct. 1993, 4 pages).

Shoulder Bolts, Chan Hsiung Factory Co., Ltd., www.allproducts.com/ manufacture9chanhsiuag/item18.html., date unknown, (1 page).

* cited by examiner

ADVANCED ARTICULATION SYSTEM AND MATTRESS SUPPORT FOR A BED

RELATED APPLICATIONS

This application is a continuation of U.S. patent application Ser. No. 11/192,698, filed Jul. 29, 2005, now U.S. Pat. No. 7,325,265, which claims the benefit of U.S. Provisional Patent Application Ser. No. 60/592,613, filed Jul. 30, 2004, both of which applications are incorporated herein by this reference.

This application is related to pending U.S. patent application Ser. No. 10/107,777, published as US 2002/0174487, filed Mar. 27, 2002; U.S. Provisional Patent Application Ser. No. 60/591,838, entitled HOSPITAL BED, filed Jul. 28, 2004 and corresponding U.S. patent application Ser. No. 11/191,651, filed Jul. 28, 2005; U.S. Provisional Patent Application Ser. No. 60/592,642, entitled PATIENT SUPPORT HAVING POWERED ADJUSTABLE WIDTH, filed Jul. 29, 2004 and corresponding U.S. patent application Ser. No. 11/192,887; and U.S. Provisional Patent Application Ser. No. 60/592,775, entitled PATIENT SUPPORT HAVING AN ADJUSTABLE POPLITEAL LENGTH, filed Jul. 29, 2004 and corresponding U.S. patent application Ser. No. 11/194,347, filed Jul. 29, 2005; all of which are hereby expressly incorporated herein by reference.

BACKGROUND AND SUMMARY

The present invention relates to articulation systems and support decks for beds, in particular, hospital beds.

A support surface for a bed or patient support is provided, wherein the bed or patient support includes first and second movable deck sections and a stationary third deck section located in between the first and second deck sections, and the support surface includes a mattress, a cover shaped to receive the mattress, a first flexible panel coupled to the cover and being located on the cover to be positioned above to the first movable deck section, a second flexible panel coupled to the cover and being located on the cover to be positioned above the second movable deck section, and a plate coupled to the cover and being located on the cover to be positioned above the third deck section. The first and second flexible panels may include a low friction material. The first and second flexible panels may be sewn to the cover. The first and second flexible panels may be movable in response to articulation of the first and second deck sections. The first deck section is configured to support an upper body portion of a person positioned on the bed or patient support, and the second deck section is configured to support a lower body portion of a person positioned on the bed or patient support. The plate is located on the cover between the first and second flexible panels. The plate includes a plurality of slots configured to engage corresponding fasteners coupled to the third deck section.

Also, a bed or patient support is provided, including a frame, an articulating deck coupled to the frame, the deck including a head section, a seat section, and a thigh section, a mattress coupled to the seat section, a cover shaped to receive the mattress, and first and second flexible panels coupled to the cover to slidably engage the head and thigh sections, respectively. The first and second flexible panels are each substantially quadrangular. The head and thigh sections may articulate and the seat section may be substantially stationary. The first flexible panel may be movable downwardly toward the seat section in response to upwardly articulation of the head section. The first flexible panel may be movable toward the head section in response to upwardly articulation of the thigh section. The second flexible panel may be movable downwardly toward the seat section in response to upwardly articulation of the thigh section.

The frame may further comprise a foot section and the second flexible panel may be movable toward the foot section in response to upwardly articulation of the head section.

Additionally, a bed or patient support is provided, including a frame, an actuator coupled to the frame, an arcuate member including a first end and a second end, and a plurality of deck sections including a movable thigh section, the first end of the arcuate member being coupled to the actuator, the second end of the arcuate member being coupled to the thigh section, and the actuator being operable to move the arcuate member to rotate the thigh section around a natural hip pivot point of a person positioned on the bed or patient support. The arcuate member may include a top portion and a bottom portion, and the bottom portion may include a v-shaped edge. The arcuate member may include a top portion and a bottom portion, and the bottom portion may include a flat edge. The arcuate member may include a top portion, a bottom portion, and an arcuately shaped slot located between the top and bottom portions.

The bed or patient support may further include a first rotatable roller located in the slot. The bed or patient support may further include a support coupled to the frame, and second and third rollers may be rotatably coupled to the support to movably engage the bottom portion of the arcuate member. The actuator may include a drive mechanism, a cylinder, and a movable rod, the movable rod being operable to move outwardly away from the cylinder to move the thigh section upwardly away from the frame, and the movable rod being operable to move inwardly into the cylinder to move the thigh section downwardly toward the frame.

In another embodiment, a bed or patient support is provided, including a frame, first and second actuators coupled to the frame, first and second arcuate members each including a first end and a second end, and a plurality of deck sections including a movable upper section, a stationary middle section, and a movable lower section, the first end of the first arcuate member being coupled to the first actuator, the second end of the first arcuate member being coupled to the lower deck section, the first actuator being operable to rotate the first arcuate member to pivot the lower deck section around a natural hip pivot point of a person positioned on the bed or patient support, the first end of the second arcuate member being coupled to the second actuator, the second end of the second arcuate member being coupled to the upper deck section, and the second actuator being operable to rotate the second arcuate member to pivot the upper deck section around a natural hip pivot point of a person positioned on the bed or patient support. The first and second actuators may each be supported by a plurality of rollers. The plurality of rollers may include a pair of bottom rollers located substantially underneath each of the first and second arcuate members. The bottom rollers may each include a substantially v-shaped groove. The plurality of rollers may include a roller located in an arcuate slot of each arcuate member.

In yet another embodiment, a bed or patient support is provided, including a frame including first and second spaced apart side frame members, an articulating deck including a thigh section, the thigh section having a first side located adjacent to the first frame member and a second side located adjacent to the second frame member, a first actuator coupled to the first side frame member, a second actuator coupled to the second side frame member, first and second arcuate members each including a first end and a second end, the first end of the first arcuate member being coupled to the first actuator, the second end of the first arcuate member being coupled to the first side of the thigh section, the first end of the second arcuate member being coupled to the second actuator, the second end of the second arcuate member being coupled to the second side of the thigh section, and the first and second actuators being operable to move the first and second arcuate members to rotate the thigh section around a natural hip pivot point of a person positioned on the bed or patient support. The first arcuate member may include a substantially v-shaped bottom end. The second arcuate member may include a substantially flat bottom end. The first and second arcuate members may each be supported by a plurality of rollers. The plurality of rollers supporting the first arcuate member may include at least one roller having a groove shaped to receive the substantially v-shaped bottom end of the first arcuate member. The plurality of rollers supporting the second arcuate member may include at least one roller having a substantially flat rolling surface.

The bed or patient support may further include a first support coupled to the first side frame member and a second support coupled to the second side frame member, the rollers supporting the first arcuate member being coupled to the first support, and the rollers supporting the second arcuate member being coupled to the second support. The frame may further include a cross member, the deck may further include a head section having a first side adjacent to the first side frame member and a second side adjacent to the second side frame member, the bed or patient support may further include third and fourth actuators coupled to the cross member, and third and fourth arcuate members each having a first end and a second end, the first end of the third arcuate member being coupled to the third actuator, the second end of the third arcuate member being coupled to the first side of the head section, the first end of the fourth arcuate member being coupled to the fourth actuator, and the second end of the fourth arcuate member being coupled to the second side of the head section. The first and third arcuate members each may have a substantially v-shaped bottom end. The second and fourth arcuate members each may have a substantially flat bottom end.

An articulation system for a bed or patient support is also provided, including an arcuate member having a top portion and a spaced apart bottom portion, at least one roller, a support, and an actuator, the actuator being operable to cause rotational movement of the arcuate member, the support being configured to couple the at least one roller to a frame portion of the bed or patient support, and the at least one roller being shaped to receive the bottom portion of the arcuate member. The bottom portion of the arcuate member may be substantially v-shaped. Each of the rollers may include an eccentric stud.

In another embodiment, an articulation system for a bed or patient support is provided, including a support, at least one v-grooved roller coupled to the support, and an arcuate member shaped to mate with and be movably supported by the at least one roller.

The system may further include an actuator operatively coupled to the arcuate member to drive movement of a portion of the bed or patient support. The arcuate member may include an arcuate slot, and a second roller located in the arcuate slot.

In still another embodiment, a bed or patient support is provided, including a movable deck section having a first side and a spaced apart second side, a frame coupled to the deck section, a first arcuate member coupled to the first side of the deck section, a second arcuate member coupled to the second side of the deck section, at least one v-grooved roller supporting the first arcuate member, at least one flat roller supporting the second arcuate member, a first support coupled to the at least one v-grooved roller and the frame, a second support coupled to the a least one flat roller and the frame, a first actuator coupled to the first arcuate member, and a second actuator coupled to the second actuator. The at least one v-grooved roller may be an eccentric roller. At least one of the flat rollers may be an eccentric roller.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which:

FIG. 13 shows an exploded view of portions of a first outer articulation system, a portion of a first inner articulation system and a connection there between.

DETAILED DESCRIPTION OF THE DRAWINGS

Figure 1:
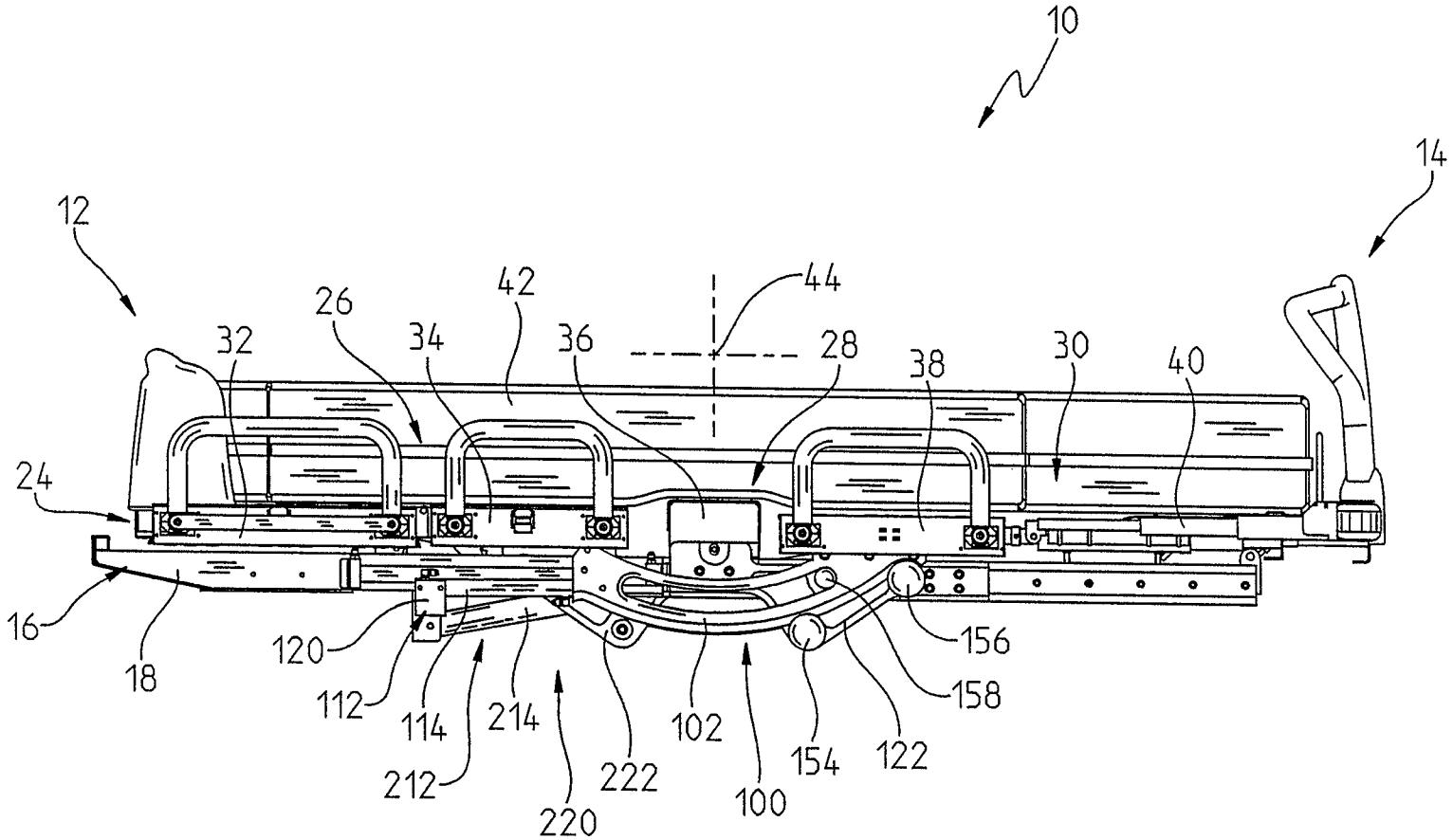
FIG. 1 is a side elevational view of a first embodiment of the present invention illustrating portions of first outer and inner articulation systems, with a bed in a flat orientation.

Referring now to the drawings, FIG. 1 shows a first embodiment of the present invention. A bed 10 has a head end 12 and a foot end 14, and includes a frame 16, a deck 24, and a mattress 42. The deck 24 is positioned above and supported by frame 16 and mattress 42 is positioned above and supported by deck 24. As shown in FIG. 1, the bed 10 is moved into a horizontal or flat position.

The deck 24 includes an upper deck portion 26, a middle deck portion 28, and a lower deck portion 30. The upper deck portion 26 of deck 24 includes a head section 32 and a back section 34. The middle deck portion 28 of deck 24 includes a seat section 36. The lower deck portion 30 of deck 24 includes a thigh section 38 and a foot section 40.

Portions of deck 24 are movable by action of one or more articulation systems 100, 200, 300, 400. Movement of the lower deck portion 30 of deck 24 is driven by first outer articulation system 100 and a second outer articulation system 300 (shown in FIG. 6). Movement of the upper deck portion 26 of the deck 24 is driven by a first inner articulation system 200 and a second inner articulation system 400 (shown in FIG. 4).

Figure 8:
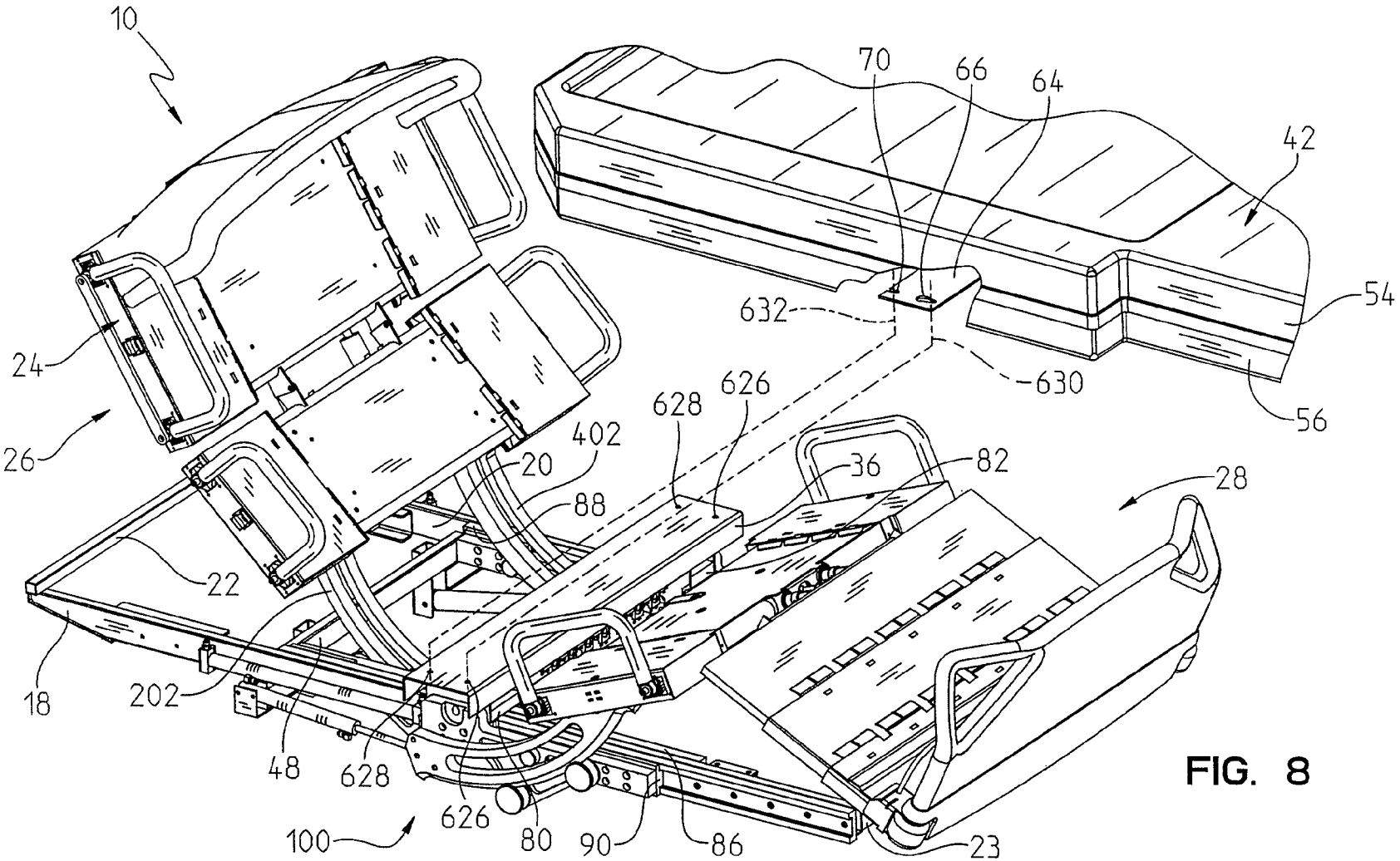
FIG. 8 shows a perspective view of the embodiment of FIG. 1 with the upper and lower deck portions elevated and a partial view of a mattress suitable for placement on the deck.

The frame 16 includes a first side frame portion 18, a second side frame portion 20, and first and second end frame portions 22, 24, as best shown in FIG. 8. Adjacent the first side frame portion 18, the first outer articulation system 100 is shown in FIG. 1.

The first outer articulation system 100 includes a first outer arcuate member 102, a first outer support 122, a first lower deck actuator 112, and a plurality of rollers 154, 156, and 158. The first lower deck actuator 112 is a standard linear actuator including a cylinder 114 and a piston or rod 116 (better shown in FIG. 2). A mount 120 couples the first lower deck actuator 112 to the first side frame portion 18 of the frame 16.

The first outer arcuate member 102 of the first outer articulation system 100 is coupled to the lower deck portion 30 of deck 24 underneath the thigh section 38. In operation, the first outer arcuate member 102 pivots around a hip pivot point 44, which is located above the mattress 42. The first outer articulation system 100 in combination with a second articulation system 300 operates to rotate the thigh section 38 around the hip pivot point 44. The first outer articulation system 100 is described in connection with FIG. 2.

A portion of a first inner articulation system 200, located within the frame 16, is also visible in FIG. 1. Portions of a first inner actuator 212, a first inner support 222 and a first inner actuator cylinder 214 are included in the first inner articulation system 200. The first inner articulation system 200 is described in greater detail in connection with FIG. 3.

Figure 2:
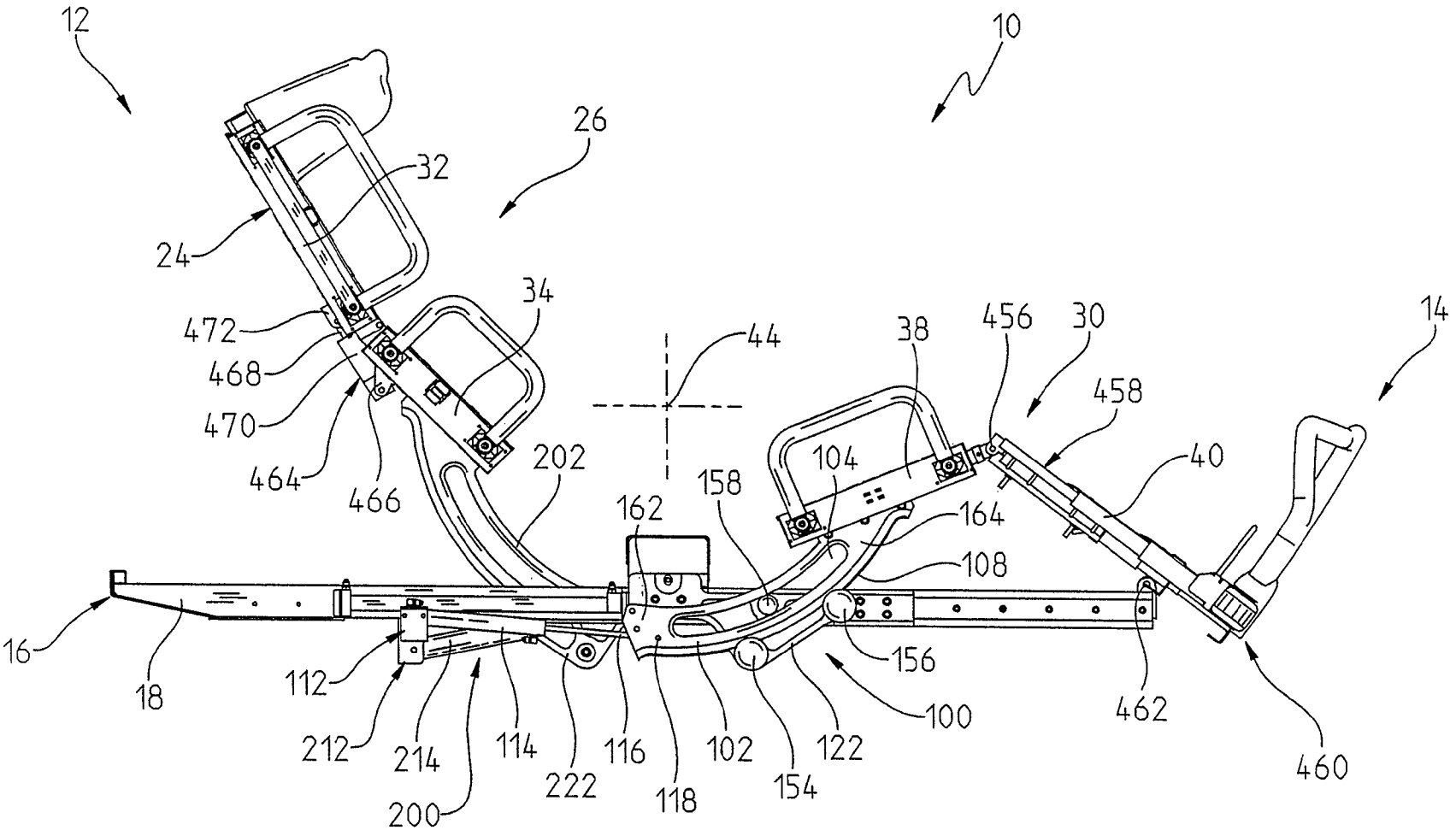
FIG. 2 is a side elevational view of the embodiment of FIG. 1, showing upper and lower deck portions moved to elevated positions.

FIG. 2 shows both the lower deck portion 30 and the upper deck portion 26 of deck 24 in elevated positions.

Movement of the lower deck portion 30 of deck 24 is accomplished by the first and second outer articulation systems 100, 300, which are located on the outside of frame 16. As shown in FIG. 2, the rod or piston 116 of the actuator 112 of the first outer articulation system 100 is extended. The rod 116 of actuator 112 moves linearly back and forth, outwardly toward the foot end 14 and inwardly toward the head end 12, and is driven by a motor coupled to the actuator 112 (not shown). When the rod 116 moves inwardly or backwardly toward the head end 12 of the bed 10, it retracts into the cylinder 114. When the rod 116 moves outwardly or forwardly in the direction of foot end 14 of the bed 10, it extends out of cylinder 114.

Figure 3:
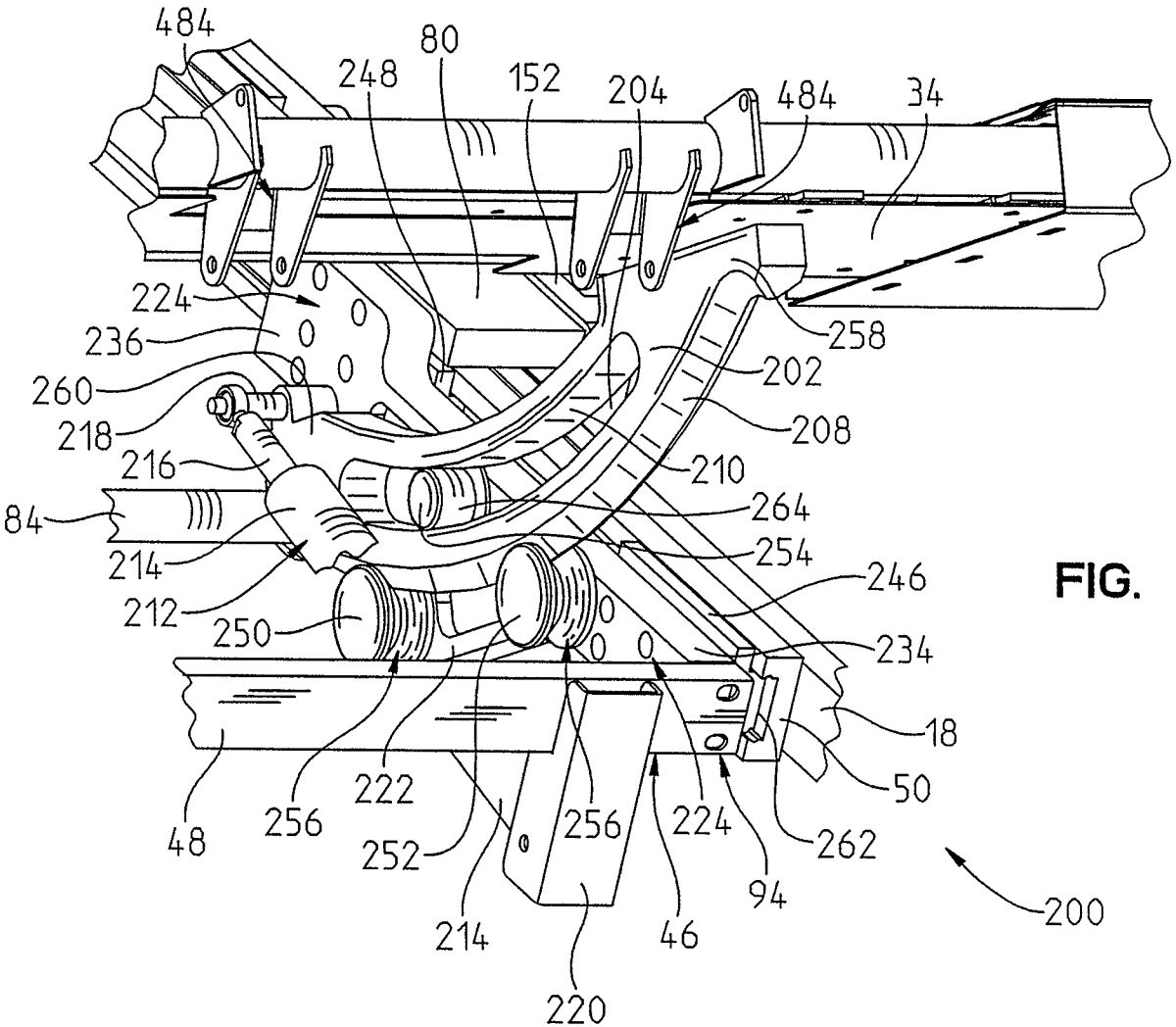
FIG. 3 shows a perspective view of a first inner articulation system of the embodiment of FIG. 1 from the perspective of a person standing in front of a first side of the head end of the bed.

The distal end of the rod 116 is coupled to a first end 162 of the first outer arcuate member 102 by a pivot coupler 118, such as the one shown in FIG. 3. Outwardly movement of the rod 116 toward the foot end 14 of the bed 10 causes the first outer arcuate member 102 to move upwardly in a counterclockwise direction, guided by a plurality of rollers 154, 156, 158, around the pivot point 44. A second end 164 of the first outer arcuate member 102 is coupled to the thigh section 38 so that movement of the first outer arcuate member 102 in a counterclockwise direction also causes the thigh section 38 to rotate around the pivot point 44 in a counterclockwise direction.

Likewise, retraction of the rod 116 into the cylinder 114 causes the first outer arcuate member 102 to move in a clockwise direction downwardly toward the frame 16. When the first outer arcuate member 102 moves downwardly toward the frame 16, the thigh section 38 is rotated clockwise around the pivot point 44 and is lowered toward the frame 16.

The foot section 40 of the deck 24 is pivotably coupled to the thigh section 38 at a joint 456. The foot section 40 has a first end 458 located adjacent the joint 456, and a second end 460 located toward the foot end 14 of the bed 10, spaced apart from the first end 458. When the thigh section 38 is elevated, the first end 458 of the foot section 40 is also elevated. However, the second end 460 of the foot section 40, which is supported by a pair of foot end rollers 462, remains adjacent to the frame 16.

As shown in FIG. 2, the first outer arcuate member 102 is supported by a plurality of bottom rollers 154, 156, and an inner roller 158. The rollers 154, 156, and 158 are rotatably coupled to a first outer support 122. The first outer support 122 is coupled to a portion of the first side frame portion 18 of frame 16, as described below in connection with FIG. 13. The rollers as described herein may be replaced with a rack and pinion system.

A bottom edge 108 of the first outer arcuate member 102 movably engages the bottom rollers 154, 156. The inner roller 158 is located within a slot 104 of the first outer arcuate member 102. The rollers 154, 156, and 158 therefore guide the movement of the first outer arcuate member 102. In the illustrated embodiment, the bottom edge 108 of the first outer arcuate member 102 is substantially v-shaped in order to correspond with substantially v-shaped grooves or indentations in the bottom rollers 154, 156, as better shown in FIGS. 8 and 13.

As mentioned above, rotation of the thigh section 38 is designed to occur about the pivot point 44, driven by the first outer articulation system 100 and the second outer articulation system 300. The pivot point 44 is located above the seat section 36, and, as shown in FIG. 1, above the mattress 42. The location of the pivot point 44 approximates the natural pivot point of a patient's hip when the patient is positioned on the mattress 42.

Also shown in FIG. 2 is the first inner articulation system 200, which, in combination with the second inner articulation system 400, articulates the upper deck portion 26 of the deck 24. The first inner articulation system 200 is located within the frame 16. The first inner articulation system 200 includes a first inner arcuate member 202, the actuator 212, the first inner support 222, and a plurality of rollers (shown in FIG. 3). The actuator 212 is a standard linear actuator, which includes a cylinder 214, a rod or piston 216 (shown in FIG. 3), and a motor (not shown). The rod 216 is coupled to the first inner arcuate member 202 via a pivot coupler 218 (shown in FIG. 3).

The first inner articulation system 200 operates in a similar manner to the first outer articulation system 100. However, the first inner articulation system 200 works in the opposite direction of the first outer articulation system 100. When the rod 216 is retracted into the cylinder 214, the upper deck portion 26 is elevated. When the rod 216 extends outwardly out of the cylinder 214 toward the foot end 14 of the bed 10, the upper deck portion 26 is lowered toward the frame 16. The first inner articulation system 200 is described in more detail in connection with FIG. 3.

Also shown in FIG. 2 is one of a pair of a head section actuators 464 pivotably coupled to the underside of the back section 34 by a mount 466. The head section actuators 464 operate in response to upwardly movement of the back section 34. When the upper deck portion 26 is elevated by the first inner arcuate member 202 to its maximum height, the head section actuators 464 operates to move the head section 32 upwardly to support the patient's head.

In the illustrated embodiment, the head section actuators 464 are standard one-way linear actuators each including a rod or piston 468, a cylinder 470, and a motor (not shown). The rod 468 is pivotably coupled to the underside of the head section 32 by a pivot coupler 472. The rod 468 is pulled outwardly away from the cylinder 470 to raise the head section 32. The rod 468 extends inwardly into the cylinder 470 automatically as the back section 34 is lowered downwardly toward the frame 16. A pair of limit switches (not shown) are mounted on the back section 34 and contact the bottom of the cylinders 470 to control the movement of the head section 32 by the head section actuators 464.

Figure 6:
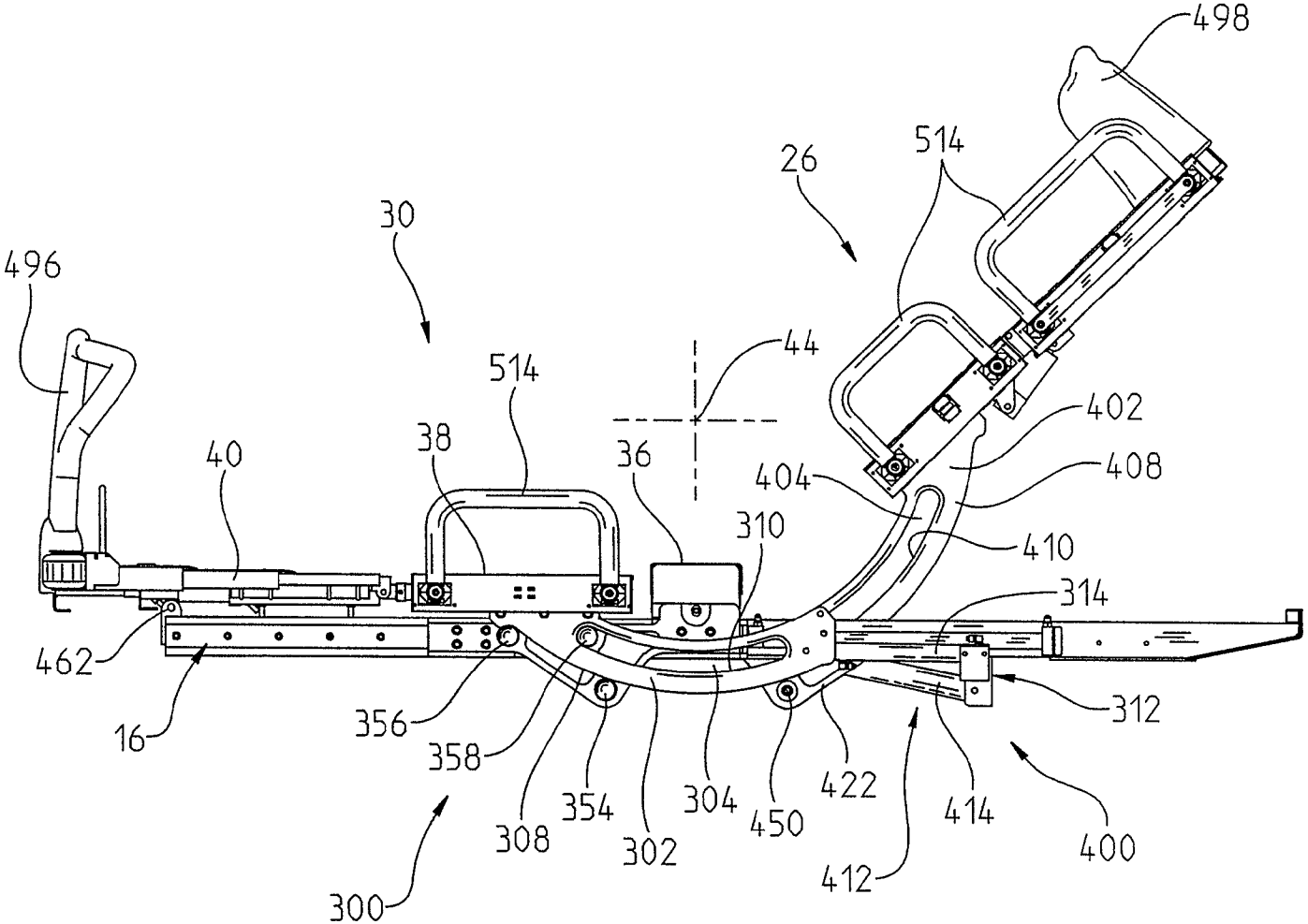
FIG. 6 shows a side elevational view of a second side of a bed opposite the side shown in FIG. 1, including second inner and outer articulation systems and the upper deck portion moved into an elevated orientation.

As mentioned above, the foot section 40 of the lower deck portion 30, when elevated, is supported by the foot end rollers 462, which are coupled to a second end frame portion 23 (best shown in FIG. 8) of the frame 16. The foot end rollers 462 are spaced apart to be, respectively, adjacent to each of the side frame members 18, 20 as best shown by FIGS. 2 and 6. When the thigh section 38 is moved downwardly toward the frame 16, the foot section 40 moves linearly, guided by the rollers 462, toward the foot end 14 of the bed 10 and flattens to become substantially horizontal, parallel with the frame 16.

FIG. 3 shows the structure of the first inner articulation system 200 in greater detail. As shown, the first inner arcuate member 202 has a first end 258 which is coupled to the underside of the back section 34. The second end 260 of the first inner arcuate member 202 is coupled to a second end 236 of the first inner support 222 via the pivot coupler 218. The first inner support 222 is coupled to an inner side of the first side frame portion 18 (within the frame 16) as follows. The first inner support 222 is coupled to inner support mounts 246, 248 via standard bolts placed through apertures 224, located on the first and second ends 234, 236 of the first inner support 222. The inner support mounts 246, 248 slide within a track 262 of a first inner side member 50 of the first side frame portion 18. The first inner side member 50 is coupled to the first side frame portion 18 of frame 16.

A block 80 is coupled to inner support mount 248, and outer support mount 152, thereby coupling the first inner articulation system 200, which is located within the frame 16, to the first outer articulation system 100, which is located outside the frame 16. The first inner support 222, the inner support mounts 246, 248, and a cross member 48 form a portion of a horizontally movable inner subframe 46 of frame 16, which is the subject of U.S. Provisional Patent Application Ser. No. 60/592,540, entitled BED HAVING A CHAIR EGRESS POSITION and its corresponding U.S. patent application Ser. No. 11/192,897, filed Jul. 30, 2004, which are hereby expressly incorporated herein by reference.

The first inner support 222 is coupled to the cross member 48 through bolts or other suitable fasteners which are thread or inserted into apertures 94 of the cross member 48.

As shown in FIG. 3, the first inner actuator 212 is coupled to the cross member 48 of the movable subframe 46 via the actuator mount 220. The cylinder 214 is shown in two parts with a portion cut away so that the bottom roller 250 can be seen. The rod or piston 216 of the first inner actuator is coupled to the second end 260 of the first inner arcuate member 202 by the pivot coupler 218. The first inner rod or piston 216 is shown in a partially extended position thus resulting in the first inner arcuate member 202 being moved to a position that is in between its lowest and highest positions.

The first inner arcuate member 202 includes a slot 204, which is, in the illustrated embodiment, arcuately shaped to correspond with the arcuate shape of the first inner arcuate member 202. A first inner roller 254 is located within the slot 204. The first inner roller 254 is coupled to the first inner support 222 as is better shown in FIG. 10*a*. The slot 204 includes an inner edge 210 which is substantially flat shaped to correspond with an outer edge 264 of the inner roller 254, which is also substantially flat.

The bottom edge 208 of the first inner arcuate member 202 is substantially v-shaped to correspond with the substantially v-shaped grooves 256 of the bottom rollers 250, 252. The bottom rollers 250, 252 are coupled to the first inner support 222 as is better shown in FIG. 10*a*.

Figures 10A, 10B:
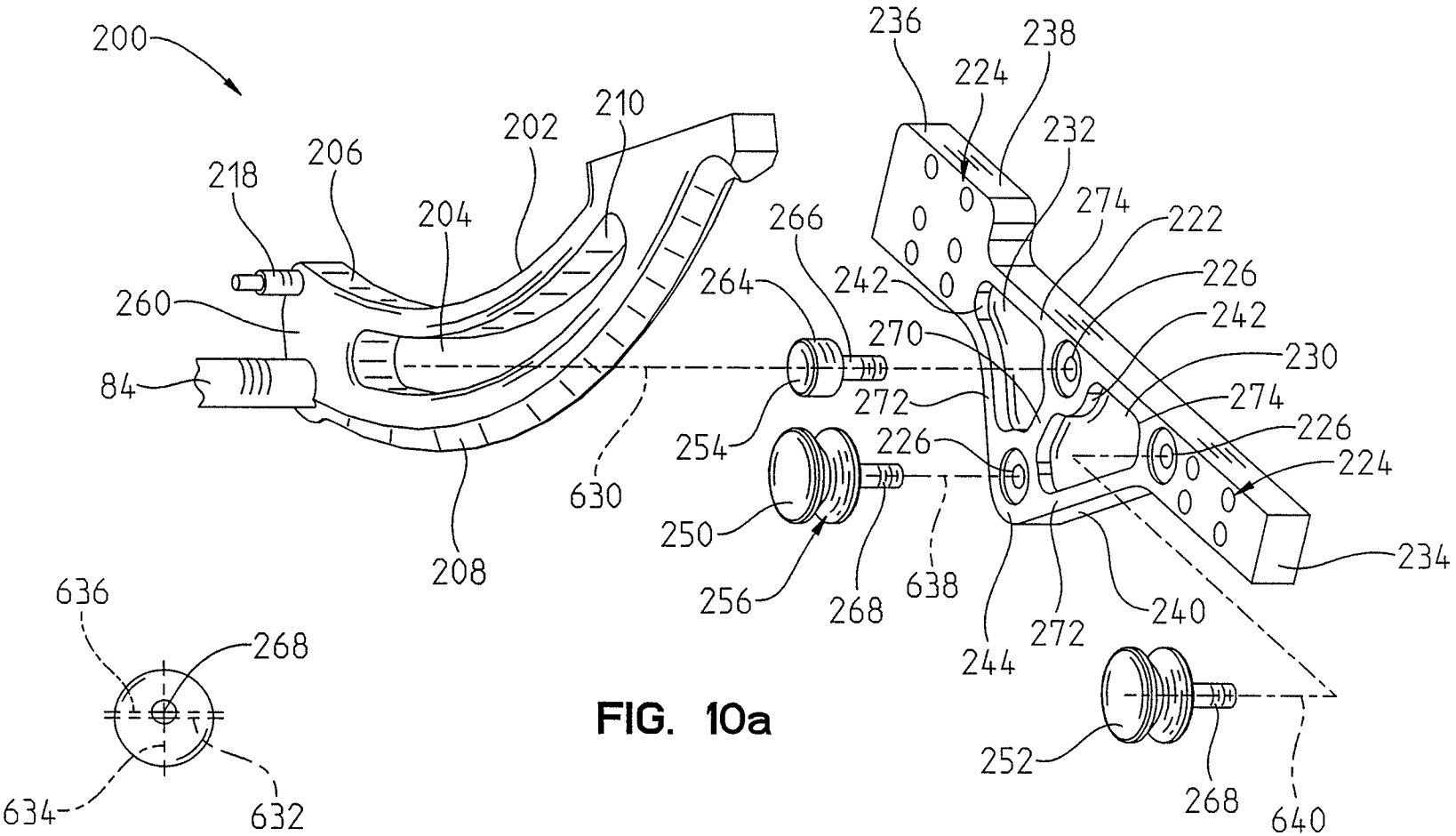
FIG. 10*a* shows an exploded view of components of a first inner articulation system.
FIG. 10*b* shows a front view of an eccentric v-grooved bottom roller with the stud coming out of the page.

A cross support 84 is also coupled to the second end of the first inner arcuate member 202 underneath the pivot coupler 218. The cross support 84 connects the first inner arcuate member 202 with the second inner arcuate member 402 (shown in FIG. 4), so that movement of the first and second inner arcuate members 202, 402 occurs substantially in unison. FIG. 10*a*, described in detail below, shows more clearly how the various parts of the first inner articulation system 200 are assembled together.

Figure 4:
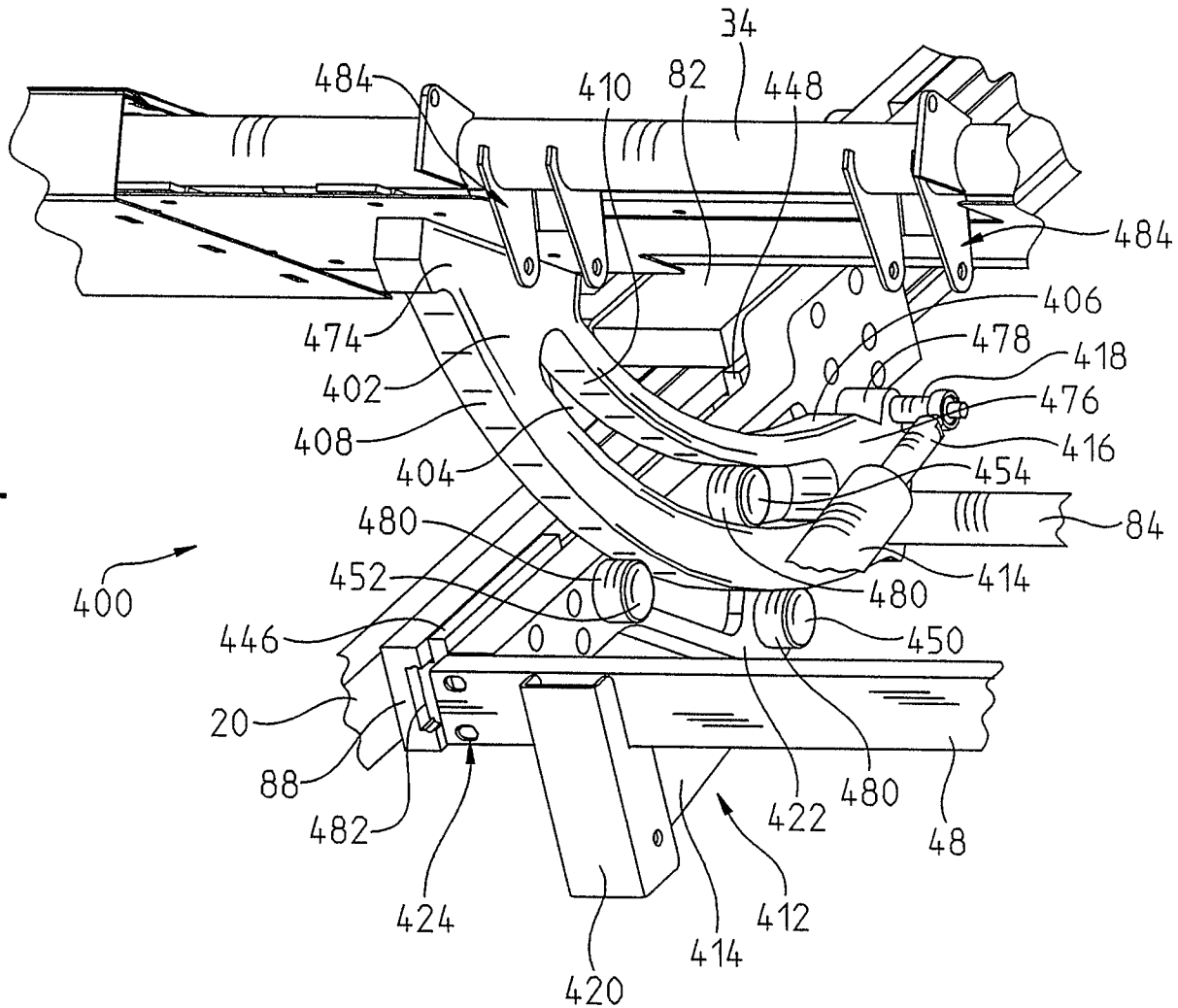
FIG. 4 shows a perspective view of a second inner articulation system of the embodiment of FIG. 1 from the perspective of a person standing in front of a second side of the head end of the bed.

The second inner articulation system 400 is located adjacent to the second side frame portion 20, as best shown in FIGS. 4 and 8. The second inner articulation system 400 is coupled to the first inner articulation system 200 by the cross support 84. The second inner articulation system 400 operates in substantially the same manner as the first inner articulation system 200, except that the second inner articulation system 400 includes flat bottom rollers.

It is understood that either side of the bed 10 may be considered the "first" side or "second" side. Thus, in alternative embodiments, flat bottom rollers may be used in the first inner articulation system 200 and v-grooved bottom rollers in the second inner articulation system, along with the corresponding arcuate members.

As discussed above, first and second inner articulation systems 200, 400, cooperate to raise and lower the upper deck portion 26 of the deck 24. The structure of the illustrated embodiment of second inner articulation system 400 is shown in greater detail in FIG. 4.

In the embodiment of FIG. 4, the second inner articulation system 400 includes a second inner arcuate member 402, a second inner actuator 412, a second inner support 422, and a plurality of rollers 450, 452, and 454. The second inner arcuate member 402 has a first end 474 coupled to the underside of back section 34, and a second end 476 coupled to the second inner actuator 412. The second end 476 of the second inner arcuate member 402 is coupled to the second inner actuator 412 by a pivot coupler 418.

As shown, the second end 476 of the second inner arcuate member 402 includes a semicircular portion 478 to which the pivot coupler 418 is coupled. The semicircular portion 478 is shaped to include an area to which a portion of the pivot coupler 418 is attached, such as an aperture or welded area. In alternative embodiments, the second end 476 of the second inner arcuate member 402 does not include the semicircular portion 478, as shown in the other drawings.

The second inner actuator 412 includes a second inner cylinder 414, a piston or rod 416, and a drive motor (not shown). The second inner actuator 412 is coupled to the cross member 48 of the movable subframe 46 by an actuator mount 420. In FIG. 4, a portion of the second inner cylinder 414 is cut away in order to show the bottom roller 450.

When the second inner actuator 412 is in operation, the piston 416 moves outwardly toward the foot end 14 of the bed 10 away from the cylinder 414 to cause the back section 34 to be lowered toward the frame 16. The piston 416 retracts inwardly or backwardly toward the head end 12 of the bed 10 into the cylinder 414 in order to elevate the back section 34 upwardly away from the frame 16.

The second inner articulation system 400 is configured so that the second inner arcuate member 402, and thus the back section 34 of the deck 24, rotate around the hip pivot point 44, which is located above the mattress 42, as shown in FIG. 1.

The second inner arcuate member 402 includes a top edge 406, a bottom edge 408, and an inner slot 404. In the illustrated embodiment, the top and bottom edges 406, 408 are substantially flat as shown. The slot 404 is arcuately shaped to correspond with the shape of the second inner arcuate member 402. The slot 404 has an inner edge 410 which is also substantially flat as shown, so that it is capable of engaging the outer edge 480 of the inner roller 454.

The second inner arcuate member 402 is supported by the rollers 450, 452, and 454. The bottom rollers 450 and 452 are standard track rollers each having a substantially flat outer edge 480 configured to engage the bottom edge 408 of the second inner arcuate member, thus supporting the bottom portion of the second inner arcuate member 402. In this embodiment, the inner roller 452 is also a standard track roller as shown.

Figures 11A, 11B:
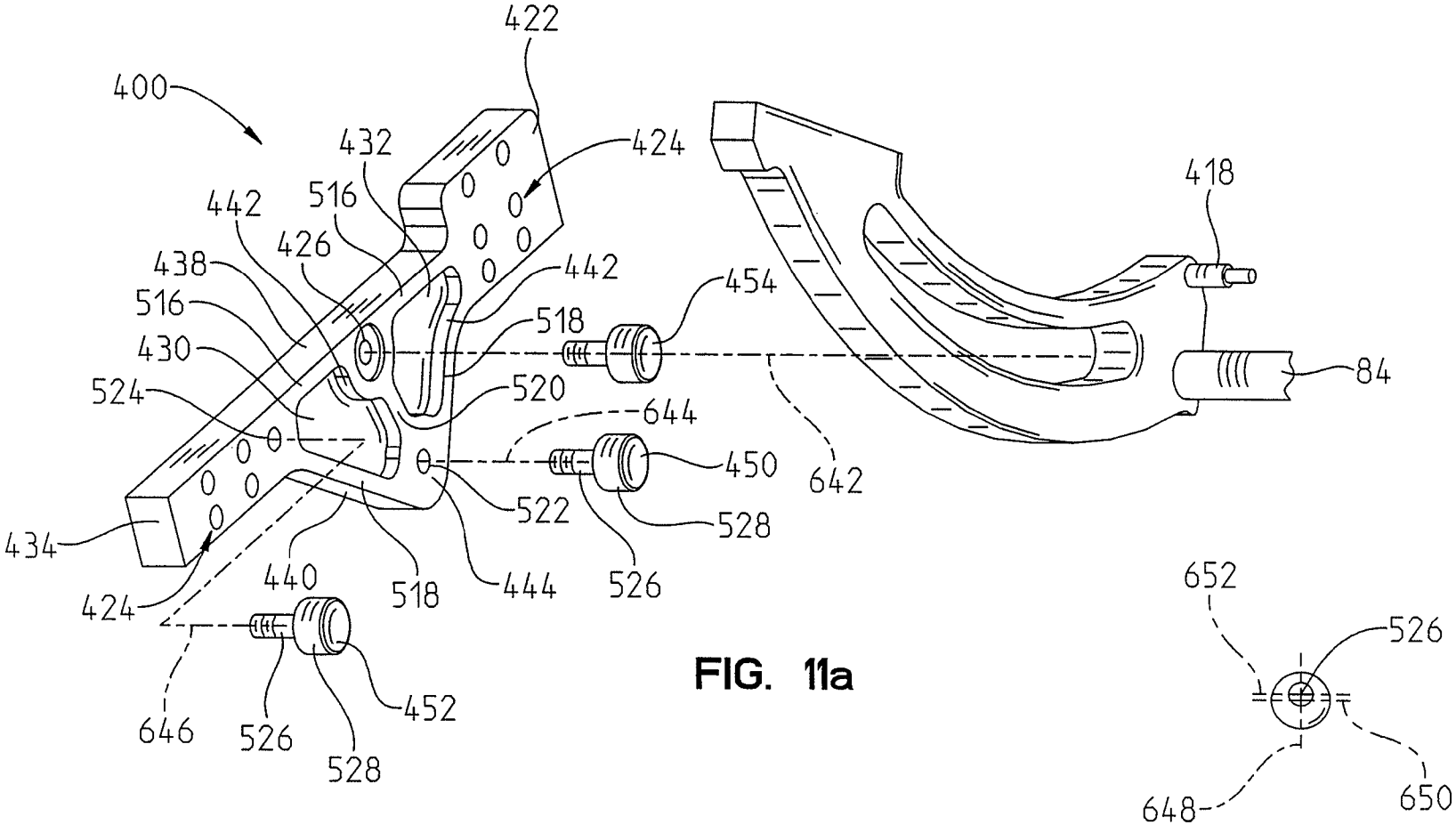
FIG. 11*a* shows an exploded view of components of a second inner articulation system.
FIG. 11*b* shows a front view of an eccentric flat-surface bottom roller with the stud coming out of the page.

The rollers 450, 452, and 454 are coupled to the second inner support 422 as best shown in FIG. 11*a*. The second inner support 422 is coupled to inner support mounts 446, 448, which slide within a u-shaped track 482 of a second inner side member 88 of the second side frame portion 20. Thus, the second inner articulation system 400 is coupled to the movable subframe 46.

Figure 12:
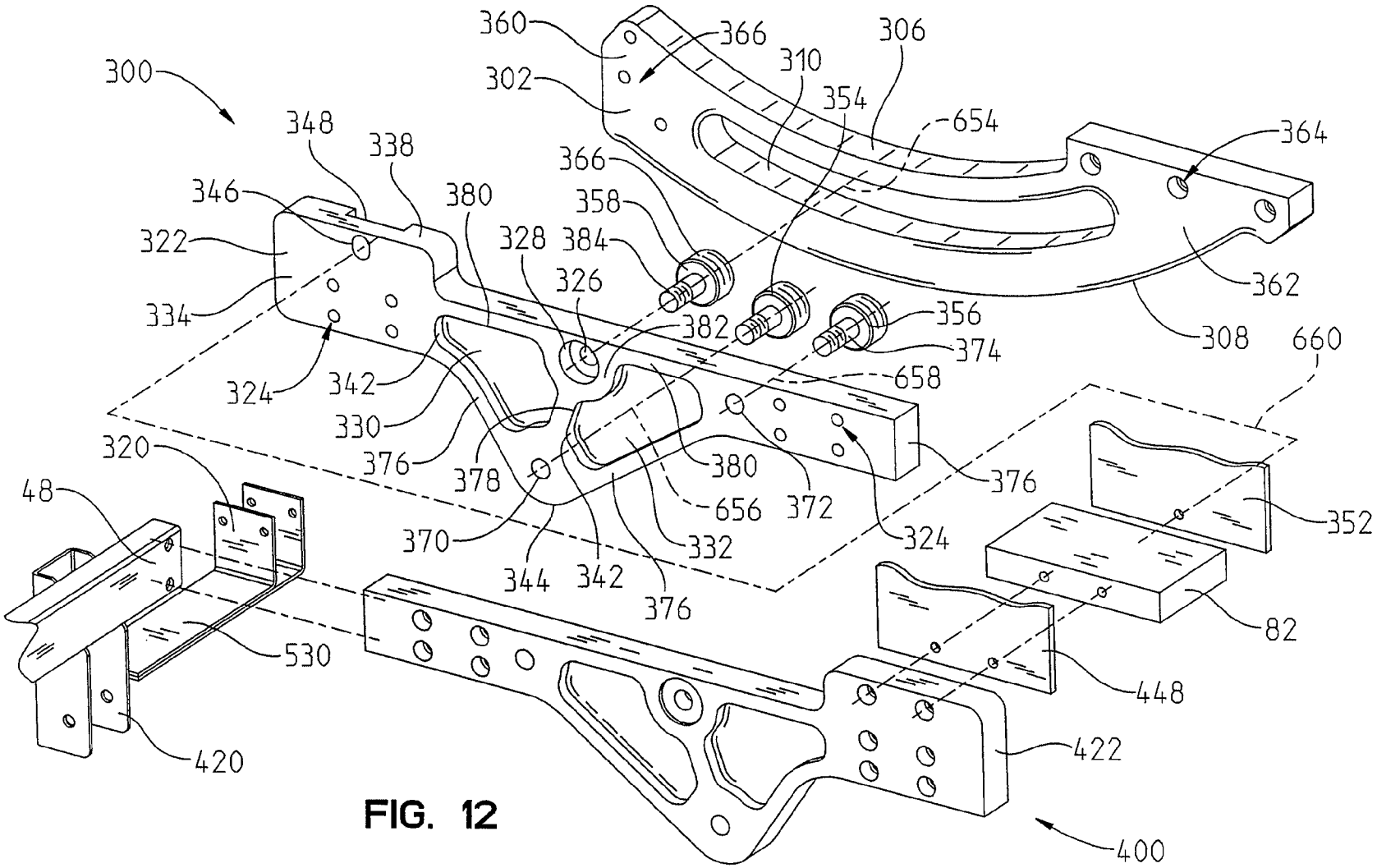
FIG. 12 shows an exploded view of portions of a second outer articulation system, a portion of a second inner articulation system and a connection therebetween.

The second inner side member 88 of the frame portion 20 is coupled to the second side frame portion 20 of the frame 16. The inner support mount 448 is coupled to a block 82 which is positioned above and extends over the second side frame portion 20 and connects with the outer support mount 352 to connect the second inner articulation system 400 to the second outer articulation system 300, as best shown in FIG. 12.

The cross support 84 is coupled to the second end 476 of the second inner arcuate member 402 and connects it with the first inner arcuate member 202. The second inner support 422 is coupled to the cross member 48 of the movable subframe 46 by bolts or other suitable fasteners inserted into apertures 424.

Also shown in FIGS. 3 and 4 are a pair of head section actuator mounts 484 which are located on the underside of the back section 34 as shown. The head section actuator mounts 484 couple the head section actuators 464 to the back section 34 in order to elevate the head section 34 when the back section 34 is elevated by the first and second inner articulation systems 200, 400 as discussed above.

Bed 10 includes a control system 486 which controls the articulation of the upper and lower deck portions 26, 30 of the deck 24 in response to input from a caregiver, patient, or other user.

Figure 5A:
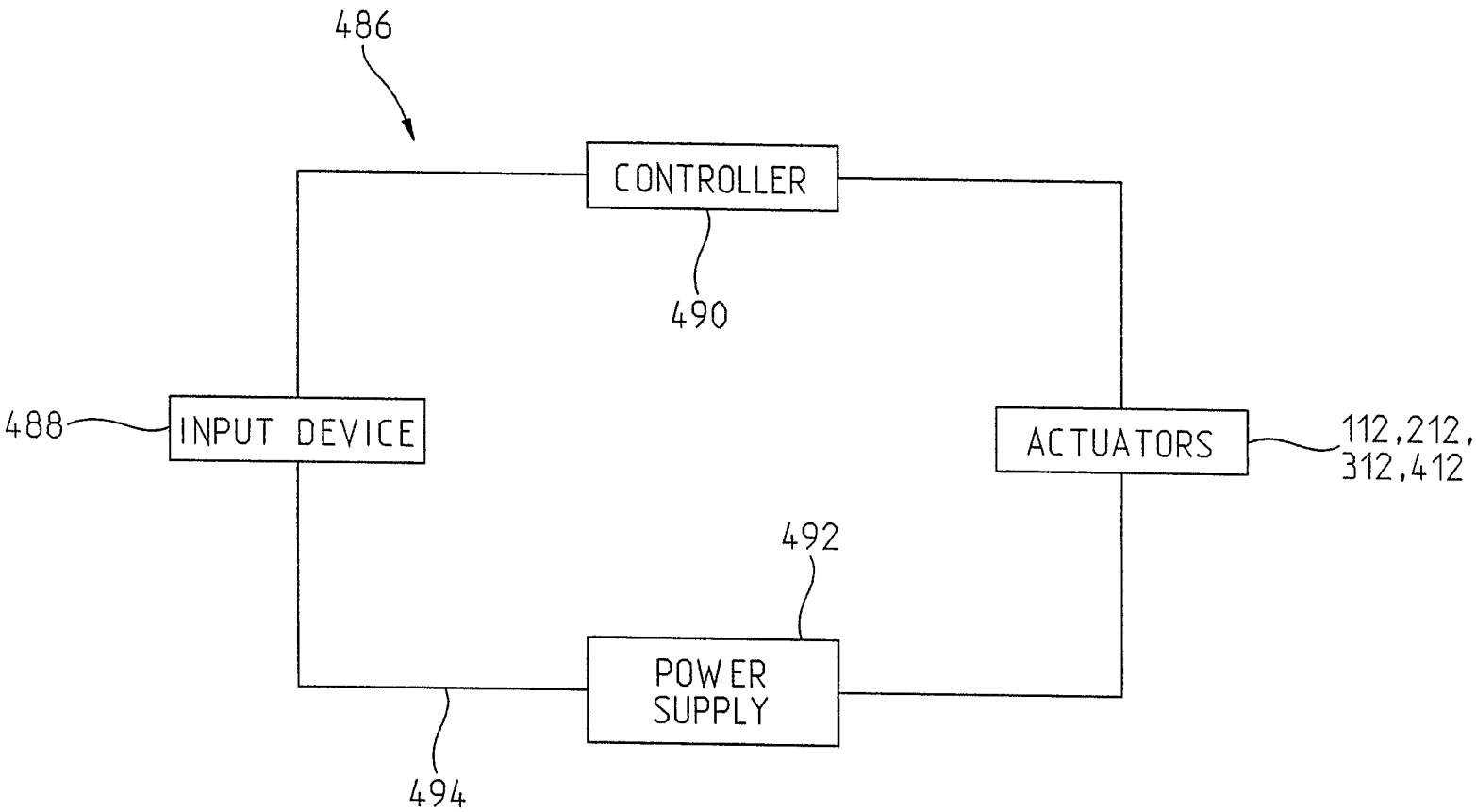
FIG. 5A shows a block diagram of a control system for the articulation systems of the present invention.

As shown in FIG. 5A, the control system 486 includes an input device 488, a controller 490, the actuators 112, 212, 312, and 412, of the articulation systems 100, 200, 300, and 400, and a power supply 492. The various components of the control system 486 are coupled by an electrical connection 494.

A caregiver, patient, or other user provides instructions to raise or lower portions of deck 24 to the control system 486 through the input device 488. The input device 488 is preferably a control panel such as the one shown illustratively in FIG. 5B, described below. Alternatively, the input device is a keyboard, keypad, touch screen, microphone or other similar device configured to receive information or instructions and convert it to an electronic input signal.

The controller 490 receives and processes the user input, using programming logic, to determine the type of control signals that need to be sent to one or more of the actuators 112, 212, 312, 412 in response to the input. The controller 490 sends the appropriate control signals to the specific actuator(s) 112, 212, 312, 412 to accomplish the action requested by the input.

For example, in response to an input signal to raise or lower the upper deck portion 26, an appropriate (i.e., "up" or "down") control signal is sent to each of the first and second inner actuators 212, 412 of the inner articulation systems 200, 400. To raise or lower the lower deck portion 30, an appropriate control signal is sent to each of the first and second outer actuators 112, 312.

The control signal includes an indicator of whether to raise or lower the specified deck portion. In addition, in certain embodiments, the control signal indicates how long the raising or lowering process should continue before stopping. In one embodiment, the duration of the raising or lowering process corresponds to how long the input device is activated. For example, in one embodiment, if the user presses a "thigh up" key for more than 2 seconds, the controller will issue a control signal to raise the lower deck portion 30 to its highest position.

The power supply 492 powers the electrical components of the control system 486 using direct or alternating current obtained, for example, from a wall socket, battery, or other suitable source.

Figure 5B:
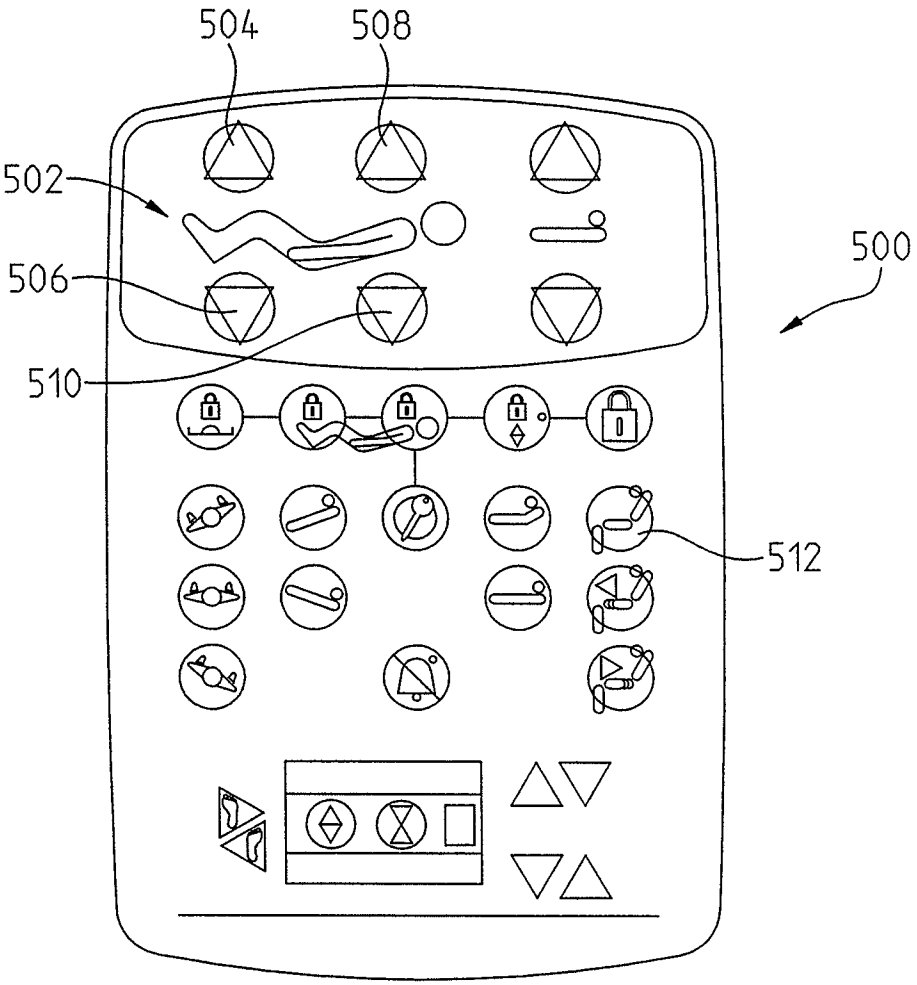
FIG. 5B shows an exemplary control panel including controls for operating the articulation systems of the present invention.

FIG. 5B shows an example schematic of a control panel input device 500, which is electrically coupled to the controller 490 to allow a caregiver, patient, or other user to input commands to raise or lower the articulating deck sections of the bed 10. In general, the control panel 500 is coupled to a portion of the bed 10 so that it is conveniently accessible by a caregiver or patient.

Activators, such as push buttons, for control of the advanced articulation systems 100, 200, 300, and 400, are displayed in area 502 of the control panel 500. Push buttons 504 and 506 when activated operate to raise and lower the lower deck portion 30 of deck 24, as discussed above. In particular, these buttons activate first and second outer articulation systems 100, 300, to cause the thigh section 38 to rotate around the hip pivot point 44.

Push buttons 508 and 510, respectively, operate, when activated by a patient, caregiver, or other user, to raise and lower the upper deck section 26 of the deck 24. Specifically, activation of either of these buttons operates to rotate the back section 34 of the deck 24 clockwise or counterclockwise, respectively, around the pivot point 44.

It is understood that in an alternative embodiments, the push buttons 504, 506, 508, 510 may be replaced with other suitable input mechanisms, such as a touch screen or voice activated controls, or other similarly designed controls known in the art. The remaining icons shown on the control panel 500 of FIG. 5B are used to activate or deactivate other features of bed 10 which are not the subject of this application. It is understood that the controls for the advanced articulation systems 100, 200, 300, 400, are not required to be located in the upper portion of the control panel 500 as shown, but may be placed anywhere suitable on the control panel 500.

A side view of the second outer articulation system 300 and second inner articulation system 400 is shown in FIG. 6, when the upper deck portion 26 of deck 24 is elevated and the lower deck portion 30 remains horizontal.

With regard to the second inner articulation system 400, the piston 416 (not visible in FIG. 6) is retracted into the cylinder 414, so that the second inner arcuate member 412 is upwardly rotated around the pivot point 44 to raise the upper deck portion 26. The second inner arcuate member 402 is supported in part by the bottom roller 450, the outer portion of which is shown in FIG. 6 coupled to the second inner support 422.

The second outer articulation system 300 is shown with the rod 316 (not visible in FIG. 6) of the second outer actuator 312 retracted into the cylinder 314, so that the second outer arcuate member 302 is lowered adjacent to the frame 16, thus keeping the lower deck portion 30 in the horizontal position.

The second inner arcuate member 402 and the second outer arcuate member 302 both have substantially flat bottom edges 408, 308, configured to mate with their respective rollers 450, 452, and 354, 356. Also, both the second inner arcuate member 402 and the second outer arcuate member 302 have substantially flat inner edges 310, 410 of slots 304, 404, to accommodate flat inner rollers 358, 454 respectively. As discussed above, it is understood that either side of the bed 10 may act as the "first" or "second" side.

As shown in FIG. 6, in the horizontal position, the thigh section 38 and the foot section 40 are in substantially the same plane. The foot section 40 is supported by the foot section rollers 462, as discussed above. FIG. 6 also illustrates how both the second inner arcuate member 402 and the second outer arcuate member 302 are positioned to pivot around the pivot point 44 through the action of the second inner articulation system 400 and the second outer articulation system 300, respectively. The pivot point 44, as discussed above, is located above the seat section 36, which, in the illustrated embodiment, remains stationary while the upper and lower deck portions 26, 30 articulate.

Also shown in FIG. 6, as well as in FIGS. 1 and 2, are a footboard 496, a headboard 498, and mattress support members 514 of the bed 10.

Figure 7:
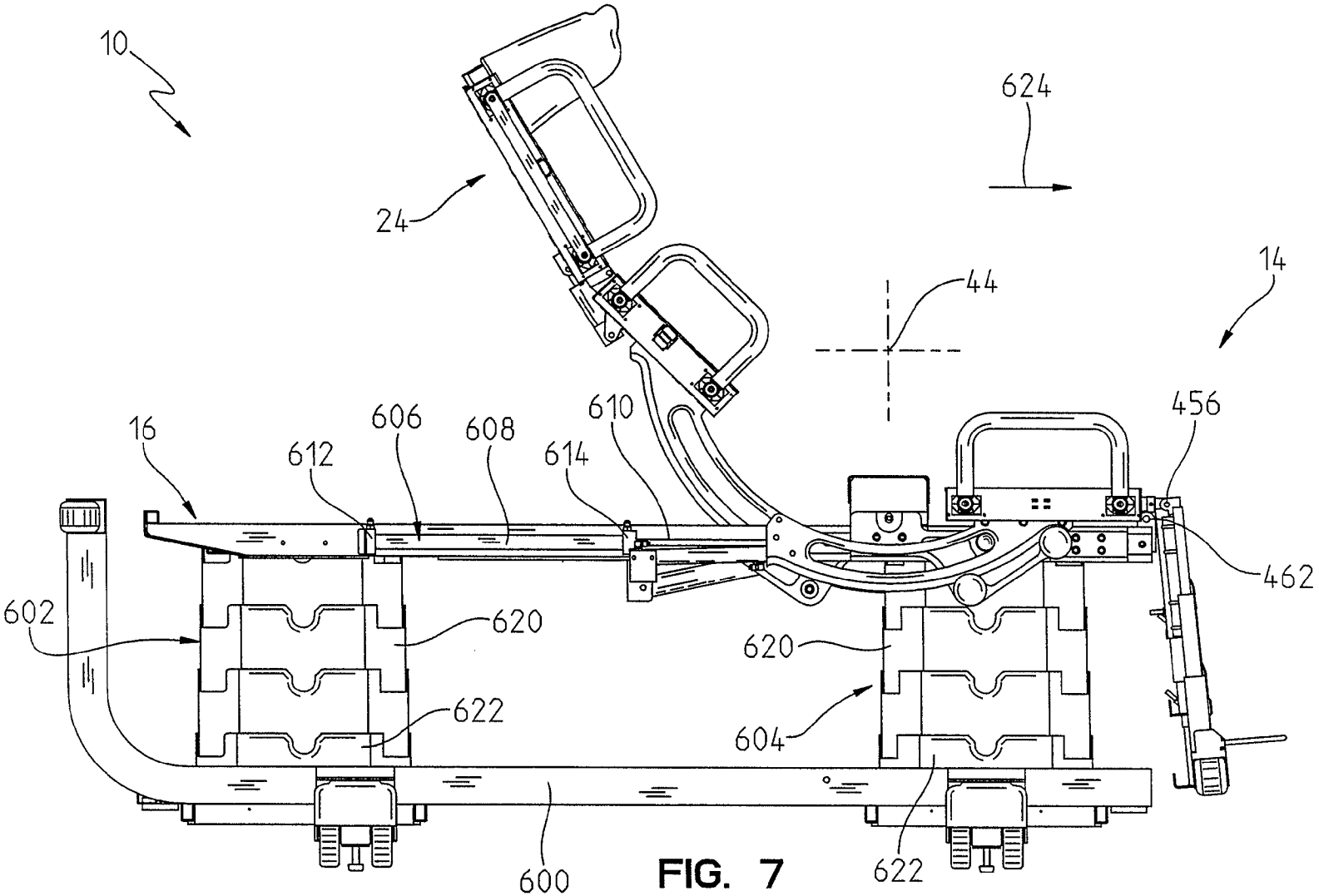
FIG. 7 shows a side elevational view of the first side of the bed shown in FIG. 1 with the deck sections moved into a chair position.

FIG. 7 shows an embodiment of bed 10 with the deck 24 moved into a chair position. In the illustrated embodiment, movement into the chair position occurs in response to activation of a push button 512 of the control panel 500 shown in FIG. 5B. As shown in FIG. 7, frame 16 is supported by a base 600 and two vertically movable frame portions 602, 604, which operate to raise and lower either or both ends of the frame 16 downwardly toward the base 600 or upwardly away from the base, in response to input of a caregiver or other user (e.g., via the control panel 500). The frame portions 602, 604 each include a plurality of nesting sections 620. When the frame 16 is lowered toward the base 600, the nesting sections 620 move downwardly into one another so that when the frame 16 is at its lowest point, all of the nesting sections 620 above the lowest nesting sections 622 are contained or telescoped into the lowest nesting sections 622.

Movement of the deck 24 into the chair position is achieved by horizontally moving the movable subframe 46 toward the foot end 14 of the bed 10 in the direction of arrow 624. This is accomplished by a pair of sliding frame actuators 606, which are coupled to the horizontally movable sliding subframe 46 on either side of the bed 10.

The sliding frame actuators 606 are standard linear actuators each including a cylinder 608, a piston 610, and a drive motor (not shown). The distal end of the piston 610 is pivotably coupled to an outer side frame member 90 of the movable subframe 46 (FIG. 8). In operation, the motor (not shown) drives the piston 610 outwardly away from the cylinder 608 toward the foot end 14 of bed 10, to move the deck 24 into the chair position, or to facilitate egress by the patient. The motor drives the piston 610 in the reverse direction inwardly into the cylinder 608 toward the head end 12 of the bed 10 to move the deck 24 into a horizontal or "sitting up in bed" position with the foot section 40 raised at least to the level of the frame 16.

The sliding subframe actuator 606 shown in FIG. 7 is coupled to the first side frame portion 18 by mounts 612, 614. A corresponding actuator 606 is similarly coupled to the second side frame portion 20 and cooperates with the sliding frame actuator 606 to move the sliding subframe 46 as discussed above. The movable subframe 46 includes portions of the articulation systems 100, 200, 300, and 400, and supports the various sections of the deck 24. Thus, movement of the movable subframe 46 also causes movement of the entire deck 24. Portions of the movable subframe 46 can be seen in greater detail in FIG. 8.

As shown in FIG. 7, when the pistons 610 are fully extended toward the foot section 14 of the bed 10, the foot section 40 rotates downwardly below the frame 16 into a vertical position that is substantially perpendicular to the frame 16. In this position, the foot section 40 is no longer supported by the frame 16 or the foot section rollers 462. The joint 456 between the foot section 40 and the thigh section 38 is positioned substantially adjacent the foot section rollers 462 as shown, when the deck 24 is moved into the chair position.

In the illustrated embodiment, movement of the deck 24 into the chair position involves elevation of the head and back sections 32, 34, as well as horizontal movement of the entire deck 24 toward the foot end 14. However, as shown in FIG. 7, when the bed 10 is in the chair position, the thigh section 38 is in its lowered position closest to the frame 16, as opposed to an elevated position. Movement of the deck 24 into the chair position does not affect the location of the pivot point 44 with respect to the back, seat, and thigh sections 34, 36, 38.

FIG. 8 shows a perspective view of portions of the bed 10 showing the upper and lower deck portions 26, 28 elevated. Both the first and second inner arcuate members 202 and 402 are shown in FIG. 8. The first outer articulation system 100 is also shown. It can be seen in FIG. 8 that the blocks 80, 82, which couple the first outer articulation system 100 to the first inner articulation system 300, and the second outer articulation system 200 to the second inner articulation system 400, are located underneath the seat section 36.

Portions of the movable subframe 46 are also shown, including the cross member 48, the inner side frame members 86, 88, and the outer side members 90, 92 (92 not visible), discussed above.

FIG. 8 also shows a portion of the mattress 42 prior to positioning on the deck 24. The mattress 42 includes a top portion 54 and a bottom portion 56. The mattress 42 is coupled to the frame 24 by a plate 64. The plate 64 is coupled to the bottom portion 56 of the mattress 42 so that when the mattress is placed on the deck 24, the plate 64 is positioned on top of the seat section 36. The plate 64 is made of plastic, metal, or other suitable substantially rigid material.

Each side of the plate 64 includes a keyhole aperture 66 and a slot 70. Each keyhole aperture 66 matches with a corresponding aperture 626 on the seat section 36 as shown by dotted line 630 and likewise each slot 70 matches with a corresponding aperture 628 on seat section 36, as shown by dotted line 632. Standard bolts (not shown) are inserted into the apertures 626, 628 on seat section 36 prior to positioning of the mattress 42 on the deck 24.

With regard to the keyhole aperture 66, a portion of the keyhole aperture 66 with a larger circumference is first positioned over the corresponding bolt on seat section 36. The remaining bolt on the same side of the seat section 36 is then positioned in the slot 70. The process is repeated to attach the second side of the mattress 42 to the second side of the seat section 36. Once the bolts are positioned in the apertures 66, 70, the mattress 42 is slid toward the foot end 14 of the bed to lock the bolts into position in the apertures 66, 70, so that the bolts that are positioned in the keyhole slots 66 are moved into narrower portions of the keyholes 66. In this way, the portion of the mattress 42 which is located above the seat section 36 of the deck 24 remains substantially stationary when the upper and lower portions of the deck 24 are articulated.

Figure 9:
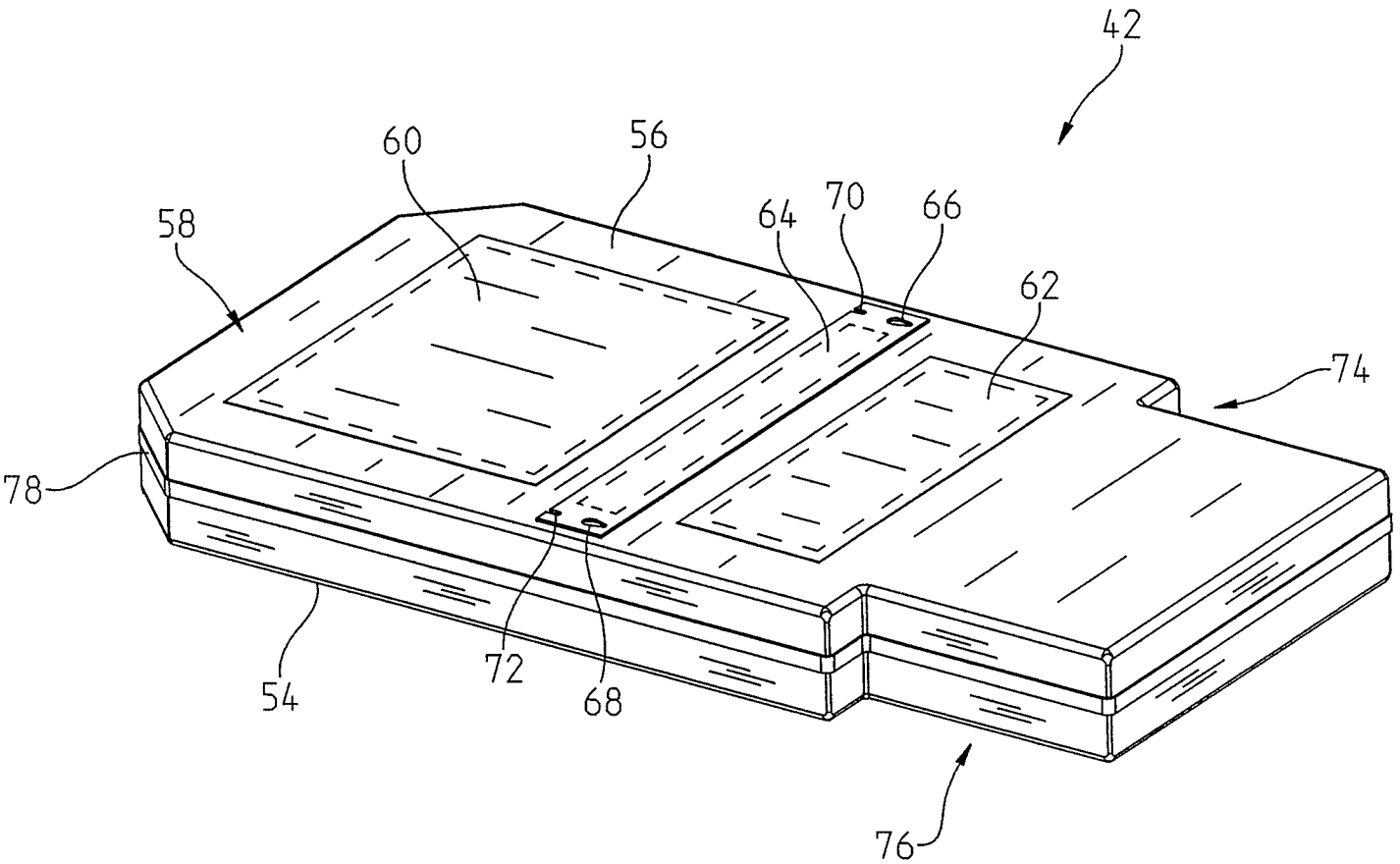
FIG. 9 shows a perspective view of a mattress suitable for use in connection with the embodiment of FIG. 1, showing the bottom side facing upward.

FIG. 9 shows a perspective view of the mattress 42. The mattress 42 is configured to fit on the deck 24 within the mattress support members 514. The mattress 42 is constructed of one or more layers of foam, air bladders, three-dimensional fiber network or other fabric, or other material suitable for supporting a patient. The foam or other suitable support material is enclosed within a cover 58.

In the illustrated embodiment, the cover 58 comprises a top portion 54 and a bottom portion 56 which are coupled together by a coupler 78 such as a zipper, snaps, buttons, Velcro, or other suitable fastener. The bottom portion 56 of the cover 58 engages the top surfaces of the deck sections 32, 34, 36, 38, 40 of the deck 24.

A first flexible panel 60 is coupled to the area of the bottom portion 56 of the cover 58 that engages the head section 32 and the back section 34 of the deck 24. A second flexible panel 62 is coupled to the bottom portion of the cover 58 so that it engages the top surface of the thigh section 38 of deck 24. The flexible panels 60 and 62 are coupled to the cover 58 by stitching, Velcro, adhesive, or other suitable fastener. Each of the flexible panels 60, 62 are constructed of a low friction material such as Teflon®, which allows the head, back and thigh sections of the mattress to slide along the head, back, and thigh sections 32, 34, 38 of deck 24, respectively, when those sections of the deck 24 are articulated. Panels 60, 62 reduce the friction between the patient and the top surface 54 of the mattress 42 when the deck section 24 is articulated.

The plate 64, including the keyhole apertures 66, 68 and the slots 70, 72 is coupled to the seat section of the mattress 42 by stitching, Velcro, adhesive, or other suitable fastener.

The illustrated embodiment of the mattress 42 also includes indented regions 74, 76, which are sized so that the width of the portion of the mattress 42 that is supported by the foot section 40 of the deck 24 corresponds to the width of the foot section 40.

FIGS. 10*a*, 11*a*, 12, and 13 show exploded views of portions of the articulation systems 100, 200, 300, 400, to illustrate the assembly of these systems.

Portions of the first inner articulation system 200 are shown in FIG. 10*a*. The first inner arcuate member 202 is shown, including the arcuately shaped slot 204 and the substantially flat inner edge 210, the substantially v-shaped bottom edge 208, and the substantially flat top edge 206. The pivot coupler 218, which couples the first inner actuator piston 216 to the second end 260 of the first inner arcuate member 202, is also shown. A portion of the cross support 84, which couples the first inner arcuate member 202 to the second inner arcuate member 402, is also shown coupled to the second end 260 of the first inner arcuate member 202. A dotted line 630 indicates that the inner roller 254 is positioned within the slot 204 when the system 200 is assembled. The bottom edge 208 of the first inner arcuate member 202 is supported by the bottom rollers 250, 252 within the substantially v-shaped grooves 256 when the system 200 is assembled.

The inner roller 254 is a standard track roller, such as can be obtained from McMaster-Carr. The inner roller 254 has a substantially flat outer edge 264 configured to engage the inner edge 210 of slot 204. Inner roller 254 also includes an at least partially threaded stud 266.

Bottom rollers 250, 252 are standard v-grooved track rollers including at least partially threaded studs 268, which can also be obtained from, for example, McMaster-Carr.

In the illustrated embodiment, bottom rollers 250, 252 are adjustable height track rollers in that the studs 268 are eccentric or off-center so that the rollers' height can be adjusted by turning the respective stud 268. This allows the distance between the rollers 250, 252 and the v-shaped bottom edge 208 of the arcuate member 202 to be adjusted for more precise alignment.

FIG. 10*b* shows an end view of the bottom rollers 250, 252 as viewed with the studs 268 pointing out of the page. The end view shows how the studs are positioned slightly off-center with respect to the radius of the bottom rollers. The intersection of the first horizontal dotted line 632 and the vertical line 634 marks the actual center of the rollers 250, 252. The intersection of the second horizontal line 636 and the vertical line 634 marks the center point of the eccentric stud 268. It is understood that the offset may occur in any direction.

Referring back to FIG. 10*a*, the at least partially threaded studs 266, 268 of the rollers 250, 252, 254 are used to rotatably couple the rollers to the first inner support 222 at the recessed apertures 226 of the first inner support 222 as shown by the dotted lines 638, 640. A washer or shoulder (not shown) may also be used in order to provide greater stability within the recessed areas of the apertures 226. In operation, the rollers 250, 252, 254 rotate to guide the movement of the first inner arcuate member 202.

The first inner support 222 includes a first end 234, which, when the first inner articulation system in assembled, is located toward the head end 12, and a second end 236 which is positioned toward the foot end 14 of bed 10. In the illustrated embodiment, the first end 234 includes a plurality (four as shown) of apertures 224 for coupling the first end 234 of the first inner support 222 to the first inner support mount 246 via standard bolts or other suitable fasteners. The second end 236 also includes a plurality of apertures 224 (in the illustrated embodiment, six) for coupling the second end 236 to the second inner support mount 248, also via standard bolts or other suitable coupling means.

As shown, the four apertures 224 on the first end 234 are arranged to form two rows of two apertures and two columns of two apertures so that each of the apertures 224 is substantially equidistant from the others. On the second end 236, the apertures 224 are arranged in two columns of three apertures each and three rows of two apertures each so that the distance between the apertures 224 in each of the columns is substantially the same for all rows. Also, each row of apertures is spaced apart from the next adjacent row by substantially the same amount of distance. It is understood, however, that any and all other suitable arrangements of the apertures 224 are within the scope of the present invention.

As shown, the apertures 224 of both the first and second ends 234 and 236 are at least partially elliptical in shape. However, it is understood that these apertures 224 could be circular, or any other suitable shape for receiving the bolts or other fasteners to couple the first inner support 222 to the first and second inner support mounts 246, 248.

The first inner support 222 also includes a substantially flat top edge 238, a substantially flat bottom edge 240, a center support member 270, and a pair of substantially triangular cavities 230, 232 separated by the center support member 270. Each triangular cavity 230, 232 includes a substantially flat inner edge 242, in the illustrated embodiment.

First inner support 222 further includes a substantially a u- or v-shaped bottom portion 244 which contains the recessed aperture 226 corresponding to the bottom roller 250. A pair of side support members 272 connect the bottom portion 244 to the first and second ends 234, 236. The substantially triangular cavities 230, 232 are defined by the side support members 272, a pair of top support members 274, and the center support member 270 as shown.

FIG. 11*a* is an exploded view showing how portions of the second inner articulation system 400 are assembled. Assembly of the second inner articulation system 400 is similar to the assembly of the first inner articulation system 200, except that on the second side of the bed 10, flat rollers are used in place of the v-grooved rollers. As mentioned above, either side of the bed 10 can be considered the "second" side.

The second inner support 422 includes a first end 434 which, when the second inner articulation system 400 is assembled, is located toward the head end 12 of the bed 10, a second end 436 positioned toward the foot end 14 of the bed 10, a bottom portion 444, a top edge 438, a bottom edge 440, a pair of substantially triangular shaped cavities 430, 432 with inner edges 442, and a plurality of apertures 424. Each of the top edge 438, bottom edge 440, and inner edges 442 are substantially flat. The triangular shaped cavities 430, 432 are defined by first and second top support members 516, first and second outer support members 518, and a center support member 520.

In the illustrated embodiment, only one recessed aperture 426 is used. The recessed aperture 426 is configured to receive the inner roller 454 as shown by dotted line 642. As shown, the remaining apertures 424, are not recessed. However, it is understood that any suitable shape, such as elliptical or circular, could be used for the apertures 424, 522, 524. The unrecessed apertures 522 and 524 are configured to receive the at least partially threaded studs 526 of the bottom rollers 450, 452 as shown by dotted lines 644, 646.

Each of the rollers 450, 452, 454 are standard flat surface track rollers which can be obtained, for example, from McMaster-Carr. However, the bottom rollers 450, 452 are adjustable height track rollers in that the studs 526 are eccentric, or positioned off-center as shown in FIG. 11*b*. The intersection of the vertical dotted line 648 and the first horizontal dotted line 650 represents the actual center of the rollers 450, 452. The intersection of the vertical dotted line 648 and the second horizontal dotted line 652 represents the center of the eccentric stud. It is understood that the offset may occur in any direction.

Referring back to FIG. 11*a*, as shown by dotted line 642, the inner roller 454, which is received by the recessed aperture 426, is positioned within the slot 404 of the second inner arcuate member 402 when the system 400 is assembled. The substantially flat bottom edge 408 of the second inner arcuate member 402 is supported by and engages the flat surface of bottom rollers 450, 452 when assembled. Also shown in FIG. 11*a*, coupled to the second inner arcuate member 402, are the pivot coupler 418 and a portion of the cross support 84, discussed above.

FIG. 12 shows an exploded view of how the second outer articulation system 300 and the second inner articulation system 400 are coupled together over the frame 16 by the block 82 and the support mounts 352, 448. Working from the portion of the articulating system 300 located outside the frame 16 inwardly toward the portion of the articulating system 400 located within the frame 16, the second outer arcuate member 302, which in connection with the first outer arcuate member 102 causes movement of the lower deck portion 30 of deck 24, is supported by rollers 354, 356, and 358. Rollers 354, 356, and 358 are coupled to the second outer support 322. The second outer support 322 is coupled to the support mount 352. The support mount 352 is coupled to the block 82 which extends over the side frame portion 20 as shown in FIG. 8. Within the boundaries of frame 16, the support mount 448 is coupled to the second side of block 82. Support mount 448 is coupled to the second inner support 422. The second inner support 422 is coupled to the cross member 48 of the movable subframe 46.

Coupled to the cross member 48 is the actuator mount 420 which supports the second inner actuator 412. Also, the movable subframe 46 includes a support plate 530 which extends outwardly away from frame 16 underneath the side frame member 20. Coupled to the support plate 530 is the actuator mount 320 which supports the second outer actuator 312. In this way, the subassembly shown in FIG. 12 is coupled to the movable subframe 46. Standard bolts or other suitable fasteners, or standard welding techniques, are used to couple the various portions of the subassembly of FIG. 12.

The components of the second outer articulation system 300 are similar to those of the first outer articulation system 100, except that flat bottom rollers are used and the bottom edge 308 of the second outer arcuate member is not v-shaped.

In the embodiment shown in FIG. 12, the second outer arcuate member 302 includes a first end 360 positioned toward the head section 12 of bed 10, and a second end 362 positioned toward the foot end 14 of the bed 10. The second outer arcuate member 302 includes a substantially flat top edge 306, a substantially flat inner edge 310, and a substantially flat bottom edge 308.

The second end 362 of the second outer arcuate member 302 includes a plurality of apertures 364 for coupling the second outer arcuate member 302 to the underside of the thigh section 32 by bolts or other suitable fasteners. The first end 360 of the second outer arcuate member 302 includes a plurality of apertures 36 for coupling the pivot coupler 318 to the second arcuate member.

The inner edge 310 of the second outer arcuate member 302 engages the outer surface 368 of the inner roller 358 as shown by the dotted line 654. The rollers 354, 356, and 358 are all standard flat surface track rollers with at least partially threaded studs, except that bottom rollers 354, 356 are adjustable height track rollers with the eccentric stud which is slightly off-center, as discussed above. These rollers are currently readily available from, for example, McMaster-Carr. Bottom rollers 354, 356 movably engage the bottom edge 308 of the second outer arcuate member 302 when the system is assembled. The rollers 354, 356, 358 are coupled to the second outer support 322 through apertures 326, 370, 372 as shown by the dotted lines 654, 656, 658.

FIG. 12 shows the side of the outer support 322 which faces inwardly away from the arcuate member 302. The second outer support 322 includes a first end 334 positioned toward the head end 12 of the bed 10 and a second end 336 positioned toward the foot end 14 of the bed 10, as well as a bottom portion 344, a top edge 338, a bottom edge (not shown), a pair of substantially triangular cavities 330, 332 having substantially flat inner edges 342.

The first end 334 of the second outer support 332 contains a plurality of substantially circular apertures 324 and a substantially elliptical aperture 346 for coupling the second outer support to the support mount 352. On the side of the first end 334 facing the second outer arcuate member 302 is a semi-circular recess 348 corresponding to the elliptical aperture 346. This aperture and recess combination is configured to support a shoulder bolt (not shown). Use of a shoulder bolt in this configuration allows for greater manufacturing tolerances. The remaining apertures 324 are configured to receive standard bolts or other suitable fasteners known in the art.

The second end 336 of the second outer support 322 includes a plurality of substantially circular un-recessed apertures 324 for coupling the second end 336 to the support mount 350. In addition, the second end 336 includes an aperture 372, which is configured to receive the threaded portion of the stud 374 of the bottom roller 356.

The bottom portion 344 of the second outer support 322 also includes an aperture 370 for receiving the threaded portion of the bottom roller 354. The substantially triangular cavities 330, 332 are defined by the bottom portion 344, the side support members 376, a center support 378 and the top support members 380. The center support 378 connects the bottom portion 334 with an at least partially circular top center portion 382. The top center portion 382 includes the recessed aperture 326 and recessed area 328 which are configured to receive the threaded portion of the stud 384 of the inner roller 358.

Figure 13:
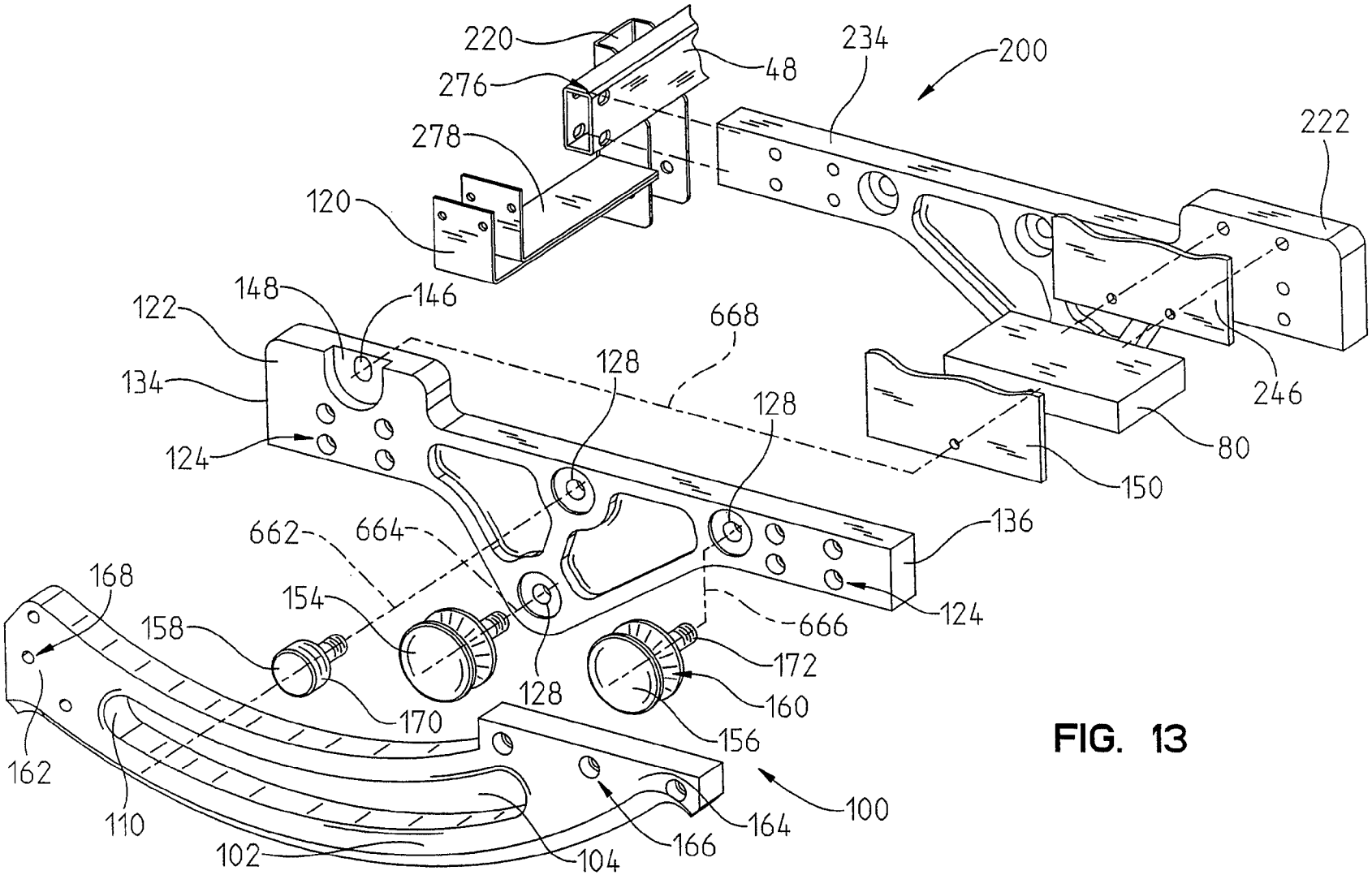

FIG. 13 shows an exploded view of how the first outer articulation system 100 and the first inner articulation system 200 are coupled together by block 80 which extends over the first side frame portion 18. Starting from the outside of frame 16 and working inwardly toward the area within frame 16, the first outer arcuate member 102 is supported by a plurality of rollers 154, 156, 158, which are coupled to the first outer support 122. The first outer support 122 is coupled to support mount 150 as shown by dotted line 68. The support mount 150 is coupled to block 80. Block 80 is coupled to the support mount 246, which is then coupled to the first inner support 222.

The first outer arcuate member 102 includes a first end 162 positioned toward the head end 12 of the bed 10 and a second end 164 positioned toward the foot end of the bed 10. The second end 164 of first outer arcuate member 102 includes a plurality of apertures 166 for coupling the first outer arcuate member 102 to the underside of the thigh section 32. The first end 162 of the first outer arcuate member 102 includes a plurality of apertures 168 for coupling the arcuate member 102 to the pivot coupler 118.

The inner edge 110 of slot 104 is substantially flat to movably engage the outer edge 170 of inner roller 158 as shown by dotted line 662. The bottom edge 108 is substantially v-shaped to movably engage the v-shaped grooves 160 of bottom rollers 154, 156. The first outer support 122 contains a plurality of recessed apertures 128 which are configured to receive the threaded portions of the rollers 158, 154, 156, as shown by dotted lines 662, 664, 666.

The first and second ends 134, 136 of the first outer support 122 also include a plurality of non-recessed apertures 124 as discussed above. The first outer support 122 is shaped substantially the same as the second outer support 422 previously discussed. FIG. 13 shows the side of the outer support 122 which faces the outer arcuate member 102 and receives the threaded portions of the studs 172 of the rollers 154, 156, and 160. As shown in FIG. 13, the elliptical aperture 146 and surrounding semi-circular recess 148 are configured to receive a shoulder bolt as discussed above.

The first end 234 of the first inner support 222 is configured to be coupled to the cross member 48 via a plurality of apertures 276 and standard bolts (not shown). Coupled to the cross member 48 is the actuator mount 220 which mounts and supports the first inner actuator 212. Also coupled to the cross member 48 and extending outwardly away from frame 16 underneath the side frame portion 18 is a support plate 278. Coupled to the support plate is the actuator mount 120 which mounts and supports the first outer actuator 112.

In the illustrated embodiments, the arcuate members 102, 202, 302, and 402, and the supports 122, 222, 322, and 422 are made of aluminum or other suitable metal, composite or other supportive material, as are the various frame and deck sections of bed 10.

Although the invention has been described in detail with reference to certain illustrated embodiments, variations and modifications exist within the scope and spirit of the invention as described and as defined in the following claims.

The invention claimed is:

1. A patient support apparatus, comprising;

a frame;

a deck coupled to the frame, the deck having a plurality of deck sections including a seat section and upper and lower deck sections, wherein the upper and lower deck sections each independently pivot between a lowered position and a raised position about a common pivot axis, the common pivot axis remaining stationary relative to and located above the seat section; at least the lower deck section being spaced from the seat section at least when the lower deck section is in the lowered position; and a mattress supported by the deck, wherein the mattress has a seat portion located above the seat section of the deck, and the common pivot axis is located above the seat portion of the mattress.

2. The patient support apparatus of claim 1, wherein the seat portion of the mattress is coupled to the seat section of the deck.

3. The patient support apparatus of claim 1, further comprising upper and lower arcuate members and upper and lower actuators coupled to the frame, wherein a first end of the upper arcuate member is coupled to the upper actuator, a second end of the upper arcuate member is coupled to the upper deck section, a first end of the lower arcuate member is coupled to the lower actuator, a second end of the lower arcuate member is coupled to the lower deck section, and the upper and lower actuators are operable to pivot the upper and lower deck sections about the common pivot axis.

4. The patient support apparatus of claim 3, wherein the upper and lower arcuate members are each supported by a plurality of rollers.

5. The patient support apparatus of claim 4, wherein the plurality of rollers includes a pair of bottom rollers located substantially underneath each of the upper and lower arcuate members.

6. The patient support apparatus of claim 5, wherein the upper and lower arcuate members each include a bottom edge and the bottom rollers each include a groove for receiving the bottom edge.

7. The patient support apparatus of claim 4, wherein the upper and lower arcuate members each include an arcuate slot and the plurality of rollers includes a roller located in the arcuate slot of an associated arcuate member.

8. The patient support apparatus of claim 4, wherein the plurality of rollers supporting the upper arcuate member are, in turn, supported by an upper support coupled to the frame and the plurality of rollers supporting the lower arcuate member are, in turn, supported by a lower support coupled to the frame.

9. The patient support apparatus of claim 3, wherein the upper arcuate member includes an upper left arcuate member and an upper right arcuate member, the upper actuator includes an upper left actuator and an upper right actuator, a first end of the upper left arcuate member is coupled to the upper left actuator, a second end of the upper left arcuate member is coupled to the upper deck section, a first end of the upper right arcuate member is coupled to the upper right actuator, a second end of the upper right arcuate member is coupled to the upper deck section, the lower arcuate member includes a lower left arcuate member and a lower right arcuate member, the lower actuator includes a lower left actuator and a lower right actuator, a first end of the lower left arcuate member is coupled to the lower left actuator, a second end of the lower left arcuate member is coupled to the lower deck section, a first end of the lower right arcuate member is coupled to the lower actuator, a second end of the lower arcuate member is coupled to the lower deck section, and the actuators are operable to pivot the upper and lower deck sections about the common pivot axis.

10. The patient support apparatus of claim 9, further comprising a cross member coupled to the upper left arcuate member and coupled to the upper right arcuate member.

11. A patient support apparatus, comprising:

an elongate frame;

a subframe coupled to the frame for longitudinal movement relative thereto;

a deck coupled to the subframe for movement therewith, the deck having a plurality of deck sections including a seat section and upper and lower deck sections each being spaced from the seat section, wherein the upper and lower deck sections each independently pivot between a lowered position and a raised position about a common pivot axis that is located above and remains stationary relative to the seat section; and a mattress supported by the deck, wherein the mattress has a seat portion located above the seat section of the deck, and the common pivot axis is located above the seat portion of the mattress.

12. The patient support apparatus of claim 11, wherein the seat portion of the mattress is coupled to the seat section of the deck.

13. The patient support apparatus of claim 11, wherein the lower deck section includes a thigh section and a lowerable foot section that is hingedly coupled to the thigh section.

14. The patient support apparatus of claim 11, further comprising an actuator coupled to the subframe to longitudinally move the subframe relative to the frame.

15. A patient support apparatus, comprising:

an elongate frame;

a subframe coupled to the frame for longitudinal movement relative thereto; and a deck coupled to the subframe for movement therewith, the deck having a plurality of deck sections including a seat section and upper and lower deck sections each being spaced from the seat section, wherein the upper and lower deck sections each pivot between a lowered position and a raised position about a common pivot axis that is located above and remains stationary relative to the seat section, wherein the lower deck section includes a thigh section and a lowerable foot section that is hingedly coupled to the thigh section, and wherein the lowerable foot section moves from a substantially horizontal position to a substantially vertical position as the subframe moves from a first position to a second position toward a foot end of the frame while the lower deck section is in the lowered position.

16. The patient support apparatus of claim 15, wherein the lowerable foot section is lowerable by gravity as the subframe moves toward the foot end of the frame while the lower deck section remains in the lowered position.

17. The patient support apparatus of claim 15, further comprising a base supported on a plurality of casters, a head end height-adjustable support coupled between the base and the frame to raise and lower a head end of the frame, and a foot end height-adjustable support coupled between the base and the frame to raise and lower the foot end of the frame, wherein the lowerable foot section is disposed substantially above and between the head and foot end height-adjustable supports when the subframe is in the first position and substantially outside the head and foot end height-adjustable supports when the subframe is in the second position.

18. A patient support apparatus, comprising;

a frame, a deck coupled to the frame, the deck having a plurality of deck sections including a seat section and upper and lower deck sections, wherein the upper and lower deck sections each pivot between a lowered position and a raised position about a common pivot axis, the common pivot axis being located above and remaining stationary relative to the seat section, an upper member supporting the pivoting of the upper deck section about the common pivot axis, and a lower member supporting the pivoting of the lower deck section about the common pivot axis, one of the upper and lower members being positioned within a footprint defined by the frame and the other of the upper and lower members being positioned outside the footprint of the frame.

19. The patient support apparatus of claim 18, wherein at least a portion of one of the upper and lower members overlaps at least a portion of the other of the upper and lower members when at least one of the upper and lower deck sections is in the lowered position and the patient support apparatus is viewed from the side.

* * * * *